US010829184B2

(12) United States Patent
McEvoy

(10) Patent No.: US 10,829,184 B2
(45) Date of Patent: Nov. 10, 2020

(54) MOORING

(71) Applicant: Technology From Ideas Limited, Co Dublin, Dun Laoghaire (IE)

(72) Inventor: Paul McEvoy, Dublin (IE)

(73) Assignee: TECHNOLOGY FROM IDEAS LIMITED, Dun Laochaire (IE)

( * ) Notice: Subject to any disclaimer, the term of this patent is extended or adjusted under 35 U.S.C. 154(b) by 0 days.

(21) Appl. No.: 16/078,724

(22) PCT Filed: Feb. 21, 2017

(86) PCT No.: PCT/GB2017/050442

§ 371 (c)(1),
(2) Date: Aug. 22, 2018

(87) PCT Pub. No.: WO2017/144867

PCT Pub. Date: Aug. 31, 2017

(65) Prior Publication Data

US 2019/0047665 A1 Feb. 14, 2019

(30) Foreign Application Priority Data

Feb. 22, 2016 (GB) ..... 1603026.4

(51) Int. Cl.
*B63B 21/20* (2006.01)
*B63B 21/00* (2006.01)
*B63B 21/50* (2006.01)

(52) U.S. Cl.
CPC ..... *B63B 21/20* (2013.01); *B63B 21/507* (2013.01); *B63B 2021/005* (2013.01); *B63B 2021/203* (2013.01)

(58) Field of Classification Search
CPC ..... B63B 2021/003; B63B 2021/005; B63B 21/20; B63B 2021/203
See application file for complete search history.

(56) References Cited

U.S. PATENT DOCUMENTS 4,426,908 A 1/1984 Ullmann
4,534,262 A 8/1985 Swenson
(Continued)

FOREIGN PATENT DOCUMENTS

DE 102007030848 B3 2/2008
EP 1304414 A1 4/2003
(Continued)

OTHER PUBLICATIONS

MIT Open Courseware "2.019 Design of Ocean Systems, Lecture 14, Mooring Dynamics III", Apr. 1, 2011 (Year: 2011).*
(Continued)

*Primary Examiner* — Andrew Polay
(74) *Attorney, Agent, or Firm* — Withrow & Terranova, P.L.L.C.; Vincert K. Gustafson

(57) ABSTRACT

A mooring line (10) comprising a metal chain (24) and an elastomeric element (28) which is attached between two points of attachment (30, 32) thereby defining a bypass section (34) of metal chain (24). The elastomeric element (28) is arranged such that when an initial tensile load is applied, the elastomeric element (28) stretches from an initial length to a longer length wherein the bypass section (34) is not taut and thus the initial tensile load is transmitted from and to further sections (24) of the metal chain through the elastomeric element (28). When a further tensile load is applied, the elastomeric element (28) stretches to a length wherein the bypass section (34) becomes taut, and thus the further tensile load is transmitted directly from and to the further sections (24) of the metal chain through the bypass section (34).

13 Claims, 15 Drawing Sheets

(56) References Cited

U.S. PATENT DOCUMENTS

| | | | | |
|---|---|---|---|---|
| 4,597,351 | A | 7/1986 | Brainard, II | |
| 5,529,293 | A | 6/1996 | Haugs | |
| 2005/0103251 | A1 | 5/2005 | Huang | |
| 2009/0202306 | A1 | 8/2009 | Huang | |
| 2014/0060413 | A1* | 3/2014 | McEvoy | B63B 21/20 114/230.1 |
| 2015/0047544 | A1 | 2/2015 | Ryu et al. | |

FOREIGN PATENT DOCUMENTS

| | | | |
|---|---|---|---|
| FR | 2887847 | A1 | 1/2007 |
| GB | 1039749 | A | 8/1966 |
| JP | 2000062684 | A | 2/2000 |
| KR | 101028046 | B1 | 4/2011 |
| WO | 03059729 | A1 | 7/2003 |
| WO | 2006105573 | A1 | 10/2006 |
| WO | 2011033114 | A2 | 3/2011 |
| WO | 2012127015 | A1 | 9/2012 |

OTHER PUBLICATIONS

Search Report for United Kingdom Patent Application No. GB1603026.4, dated Jul. 27, 2016, 4 pages.

International Search Report and Written Opinion for International Patent Application No. PCT/GB2017/050442, dated May 18, 2017, 11 pages.

* cited by examiner

MOORING

This application is a 35 U.S.C. § 371 national phase filing of International Application No. PCT/GB2017/050442 filed on Feb. 21, 2017, and claims the benefit of United Kingdom Patent Application No 1603026.4 filed on Feb. 22, 2016, wherein the disclosures of the foregoing applications are hereby incorporated by reference herein in their respective entireties.

The present invention relates to mooring lines and mooring systems, and related connectors and methods for attaching a mooring line, for mooring or tethering a floating or submerged object in a body of water. The disclosed mooring lines, mooring systems, related connectors and related methods enable load reductions and shock protection to be achieved as compared to traditional mooring systems.

Mooring lines have long been used to secure floating objects. The moored objects are often extremely expensive, or can be dangerous if free to move and collide with other objects, and thus the mooring lines are often over-engineered to ensure that they do not fail.

Many different types of mooring line are used throughout the world, with a catenary mooring line being the most common. In a catenary mooring line, a length of chain (or weighted line) is attached from an anchor to the device being moored. The loads from the ocean apply on the moored device and try to move it. The length of chain is substantially longer than the seabed depth (e.g. 3, 5 or 7 times the depth) and the weight of the chain acts as a restoring force to any motion. As the moored object is moved from its rest position away from the anchor, more of the chain length lifts off the seabed increasing the mass of chain responsible for the restoring force. This increase in force helps pull the device back to its rest position. Over-engineering this line typically means adding extra mass (e.g. using a thicker chain) so that the restoring force is greater. To counter the weight of this extra mooring line mass, the device being moored may need larger ballast resulting in an increase in its size, and hence an increase in the loads applied by the ocean.

An alternative approach is to use a mooring line which can stretch and which has a restoring force related to the stretch in the line. Typically these are rope or synthetic lines such as Polyester or Nylon. These lines have a small quantity of elasticity in their fibres and a small additional level of elasticity from their braiding design, but can usually only elongate by a few percent before reaching their breaking load (e.g. typically <<50%). In this scenario the restoring force is coming from the material properties and the compacting of the line. Over-engineering this line typically involves using bigger ropes with higher material properties and larger braids. Such ropes often have to be very long to deliver enough elongation to absorb the energy trying to move the device.

Multiple mooring lines are often used to split and share the restoring force. If the applied ocean force can come from multiple directions then multiple lines are often required in different directions to keep the device within a desired ocean 'footprint'.

The main purpose of a mooring line is to control relative movement between the object being moored and its tether point. Such movement may be caused by wave, current and/or tidal motion. The mooring line must therefore apply a restoring force against movement of the object. It can be difficult to meet the demands on a mooring line where the object to be moored experiences relatively large displacements relative to the depth of water. In these environments it is desirable that the scope of the mooring line is not too large as this increases cost, where the "scope" is defined as the length of mooring line per unit of water depth. It is also desirable to minimise the footprint of the mooring system, where the "footprint" is the seabed area occupied by the mooring system.

As mentioned above, mooring lines are typically comprised of long metal chains that form a catenary mooring system. These catenary mooring lines utilise a metal chain which is attached to the object to be moored, the metal chain then goes down to the seabed where often up to 2 km of chain is laid across the sea bed, before ending in an anchor. FIG. 1 is a schematic diagram of a basic single point catenary mooring conventionally used to tether a floating structure 4 such as a tidal platform. The catenary mooring line comprises a free hanging line or cable 8, typically a steel chain, running horizontal to the seabed. The restoring force of the mooring line 8 is primarily generated by the hanging weight and pre-tension in the line. FIG. 1 shows that, as the water depth increases due to large waves, the catenary chain 8 is lifted off the seabed 6 as the platform 4 drifts upwards and to the left. As the water depth decreases, the chain 8 is laid along the seabed 6 and the platform 4 drifts downwards and to the right. Thus very large amounts of chain and a large space envelope is required to allow horizontal movement of the platform as the water depths rise and fall. This results in very high material costs for the mooring system and restricts the positioning of the platform in an array. Catenary mooring systems can be used even in deep sea applications but the chain must be made so long that it does not exert any vertical load at the anchor point.

Due to the horizontal load reacting nature of the conventional drag embedded anchors which are used with catenary systems, the scope of the cable must be chosen such that the cable is never entirely picked up from the seabed for the given environmental conditions. Large waves can be up to 20 m high, i.e. the same order of magnitude as the water depth, and the length of chain required to deal with such changes then becomes very large. A scope of three suffices in many scenarios, but in shallower water a scope of more than five is frequently required, and scopes of >7 are often needed in extreme scenarios. Such a mooring system is often inefficient and takes up a lot of seabed space around the object, resulting in high costs and a large footprint. In the most extreme conditions the horizontal mooring force on a steel catenary system can be greater than 5000 kN.

A further challenge for mooring systems is fatigue, as the mooring lines tend to wear. There are many causes for such wear with the primary causes being from friction at any contact point (e.g. the seabed touch down point) and from material wear due to large variations in load within the mooring line. For a chain the wear comes from friction at the link contact points and results in the metal slowly wearing away and reducing the load holding capability of the line. For a rope the wear results from fibres rubbing against each other and breaking/fraying, reducing the load holding capability of the line. Reducing these variations reduces the wear on the line in both cases with large savings in inspection and replacement costs.

Whilst a catenary mooring line largely absorbs loads which are applied to the mooring line, the snatch loads and peak loads on the mooring line can be extremely high. Snatch loads are short, fast-acting loads that are applied to the mooring line when the tethered object experiences a sudden displacement. These loads arise due to the inelastic nature of the metal chain and the rapidly changing wave conditions. High snatch loads can be detrimental to the chain, causing fatigue which can often cause the chain to fail. Peak loads are the maximum loads experienced by a mooring line during operation. Whilst repetitive small loads can cause fatigue of the mooring line, the higher peak loads are known to cause the mooring line to fail in certain circumstances.

Accordingly there are a number of problems when it comes to implementing a catenary mooring system to tether a floating object, especially in offshore environments. In particular, very large scopes, seabed footprints and horizontal motion envelopes are required by a catenary mooring system to allow the object to ride the waves. In addition, the metal chains suffer fatigue and potential failure. Other problems include noise emissions, seabed scouring, roll and pitch, and cost.

Mooring components comprising elastomeric material are popular in near shore and dock mooring applications. Examples are seen in US 2005/0103251 and US 2009/0202306. Such proposals provide a number of advantages over traditional mooring solutions by allowing a flexible component inserted into the line to stretch with the heave and surge of the floating vessel or platform. However, these mooring systems are principally designed to prevent drift or buffer tidal currents, and are not designed to provide low scope, small footprint performance in deeper waters. In these mooring components one or more rubber strands may be combined in parallel with a so-called bypass cable (or "safety-locking loop") formed of stiff synthetic fibre or steel wire that prevents the rubber strand(s) from over-extending. Such components are typically designed with the rubber elements designed to hold the full mooring load and the "safety locking loop" rarely if ever required. Such components are limited in the lengths to which they can be made, as the synthetic fibre or steel bypass cable can add disproportionately to the weight of the component. In practice such lines are no more than about 10 m long and therefore find most use in mooring pontoons and boats in a marina. The braided synthetic ropes in some of these components can also suffer from wear problems. Furthermore, such a "safety locking loop" would cause a significant problem in terms of very high peak forces in response to elongation beyond the working range of the rubber strands. Not designed for high wave loads, orders of magnitude above the normal load, these components suffer significant snatch loads when the "safety locking loop" is forced to engage, for which they are not designed. Accordingly these mooring components only work well where the change in wave height is small with respect to the depth of water in which the mooring is used, such as in-harbour pontoons, or in estuaries where tidal changes in water height are low. Such mooring components are not designed for offshore use where objects may be subject to storms and very large waves.

More recently, it has been proposed for mooring components made of elastomeric elements to be used in traditional mooring lines to reduce the loads on the line, as can be seen in the Applicant's earlier applications WO 2011/033114 and WO 2012/127015. These publications describe elastomeric mooring solutions where an elastomeric component is inserted part way along a conventional mooring line. In these examples the elastomeric component completely replaces a section of the mooring line, i.e. connected between sections of steel chain. This means that the lines in the mooring system can be much shorter because the elastomeric components allow for a large degree of elongation and reduce the loads significantly. The elastomeric components may even reduce the vertical forces in the mooring system to a level that means anchors can be connected directly to the ocean floor instead of laying chains along the seabed.

Inserting elastomeric components into mooring lines can significantly reduce the loads on the mooring system, often by up to 90%, and thus the chances of the mooring line failing are relatively small. However, in mooring systems where an elastomeric component is physically inserted into the conventional mooring line and completely replaces a section of the steel chain, the chain must be physically broken and this may be perceived as potentially introducing a point of weakness into the mooring line. There could be concerns that if the elastomeric component, or its attachment points, were to fail or be damaged by some unknown process (e.g. more susceptible to shark bites or bio-organisms) before the steel chain then this would cause the mooring line to completely fail early.

Ideally, a deep sea mooring system needs to be adaptable to the sea states at the location at which it is placed and so it must be able to adjust its response to the applied forces from the waves over very short time periods. Ideally, shock protection from snatch loads should be combined with overall performance in handling high peak loads. Ideally, such a mooring system is self-adjusting so that risk of failure in harsh environments is reduced. Ideally, the mooring system has a failsafe component such that the mooring line is unlikely to fail. Furthermore, any mooring system should also be cost-effective.

The present invention seeks to provide improved mooring lines and systems that can withstand relatively large changes in wave height and/or tidal motion while having a low scope, small footprint and reduced risk of failure (whether that risk is actual or perceived).

Thus in accordance with a first aspect, the present invention provides a mooring line comprising a metal chain and at least one elastomeric element having an initial length; wherein the at least one elastomeric element is attached between two points of attachment on the metal chain thereby defining a bypass section of the metal chain between the two points of attachment with a predetermined length that is greater than the initial length of the at least one elastomeric element; wherein one or more further sections of the metal chain are directly linked to the bypass section by chain links so as to transmit a tensile load directly from one section of the metal chain to the next; and wherein the at least one elastomeric element is arranged such that: when an initial tensile load, below a threshold tensile load, is applied to the mooring line in use, the at least one elastomeric element stretches from the initial length, to a second, longer, length wherein the bypass section of the metal chain between the two points of attachment is not taut and thus the initial tensile load is transmitted from and to the further sections of the metal chain through the at least one elastomeric element; and when a further tensile load equal to or above the threshold tensile load is applied to the mooring line in use, the at least one elastomeric element stretches further from the second length to the predetermined length wherein the bypass section of the metal chain between the two points of attachment becomes taut, and thus the further tensile load applied to the mooring line is transmitted directly from and to the further sections of the metal chain through the bypass section of the metal chain.

It will be appreciated by those skilled in the art that such a mooring line provides one or more elastomeric element(s) capable of absorbing tensile loads applied to the object being moored, thereby reducing the peak loads on the metal chain. There are two primary ways in which this benefit can be used. In embodiments where the at least one elastomeric element is attached between two points of attachment on the metal chain of an existing mooring line, the reduction in peak loads may dramatically reduce wear and tear. This means that the lifetime of the mooring line may be extended and maintenance costs may be reduced. In embodiments where a mooring line is installed with the at least one elastomeric element pre-attached, the metal chain can be chosen to be smaller in size than in a conventional mooring line, e.g. the length of the chain and/or size/weight of the chain links chosen for the lower expected peak loads. Taking advantage in this second way means that both capital and operational cost benefits are delivered. The elastomeric element(s) also provide excellent shock protection and can eliminate snatch loads as compared to a traditional catenary mooring line.

It will be appreciated that the presence of the further sections of metal chain means that at least one, and preferably both, of the two attachment points is not at the end of the metal chain in the mooring line. In other words, the predetermined length of the bypass section of the metal chain is shorter than the total length of the metal chain in the mooring line.

In embodiments of the present invention, such a mooring line advantageously retains a continuous, unbroken, metal chain along its entire length as a failsafe in the unlikely event of failure of the elastomeric element(s). It is therefore preferable that the bypass and further sections of the metal chain are directly linked by chain links so as to form a continuous metal chain. When a relatively high tensile load is applied to the mooring line, equal to or above the threshold tensile load, the elastomeric element(s) stretches to such an extent that the bypass section of chain becomes taut and thus any further tensile load is transferred directly along the linked sections of the metal chain. This arrangement ensures that larger tensile loads are transferred along the metal chain, which may be perceived to be considerably stronger than the elastomeric element. This arrangement provides the security that, even in the unlikely event that the elastomeric element(s) were to break, the metal chain would remain to provide an unbroken mooring line. The fact that the metal chain itself forms the failsafe for the mooring line means that the mooring line is not considered to be weakened by inserting the elastomeric element(s) and this provides confidence in performance. In at least some embodiments the bypass and further sections of the metal chain consist of chain links of the same grade. This means that the various sections of the metal chain all consist of the same size/thickness and weight i.e. grade per link. Thus it can be ensured that all sections of the metal chain are designed to withstand the peak loads expected for the mooring line. All of these embodiments are advantageous over the elastomeric mooring components seen in the prior art where a separate metal cable may be provided as a "safety locking loop" but there is no direct link to any further sections of metal chain outside the mooring component. In addition, the separate "safety locking loop" provided in prior art components may be formed from braided wire and is often weaker than the typical metal chains used in mooring lines.

The at least one elastomeric element may be designed to provide a tensile response to the bulk of normal expected wave states for a given mooring line. Accordingly the elastomeric element(s) may stretch to elongations (i.e. a second length) that are less than the length of the bypass section of metal chain in response to the tensile loads applied to the mooring line most of the time. Even absorption of relatively small loads can provide a significant benefit as the elastomeric element(s) absorbs energy before the metal chain is engaged. This is what provides for an overall load reduction so that the mooring line can be shorter than a conventional catenary system using metal chains alone, or the same length but benefiting from reduced wear. If a relatively large tensile load is applied, for example in a storm, then the elastomeric element(s) may be caused to stretch to the predetermined length at which the bypass section of metal chain becomes taut and the full tensile load is then transferred along the sections of the metal chain.

Thus in many embodiments it is preferable that the initial length is less than the second length and the second length less than the predetermined length. Further preferably there may be a wide range of lengths available for the second length, so that the at least one elastomeric element provides for a relatively high degree of elongation before reaching the predetermined length at which the bypass section of the metal chain, between the two points of attachment, becomes taut. However the bypass section of chain may frequently become taut in higher sea states. The Applicant has found that even a relatively small volume of elastomeric material can provide huge benefits in lowering the overall loads experienced by the metal chain in the mooring line.

The length of the bypass section of metal chain between the points of attachment effectively determines the predetermined length to which the at least one elastomeric element can stretch. Limiting the maximum elongation of the elastomeric element(s) reduces the risk of the at least one elastomeric element failing. Often mooring components in the prior art have been over-engineered to account for the fact that an elastomeric element might fail. For example, a plurality of elastomeric elements may be provided in case a single elastomeric element fails. The combined response provided by the plurality of elastomeric elements may not actually be necessary to absorb normal loads but is provided as a failsafe to prevent damage. According to the present invention, on the other hand, the bypass section of chain prevents the at least one elastomeric element from stretching too far, this means that additional elastomeric elements do not need to be provided to prevent failure of the mooring line. As a result, a single elastomeric element can be provided safe in the knowledge that the elastomeric element will be unlikely to fail. Thus in preferred embodiments the mooring line may comprise a single elastomeric element attached between the two points of attachment on the metal chain. This is particularly advantageous as the elastomeric elements used within mooring lines are often extremely expensive and thus reducing the total number of elastomeric elements required reduces the cost.

It will be appreciated that the mooring line has a failsafe which is provided by the directly linked sections of metal chain, however in some less preferred embodiments it is envisaged that the mooring line may be provided with additional failsafe lines if desired. For example, a non-elastomeric cable (e.g. made of stiff synthetic material or metal) may be attached in parallel with the at least one elastomeric element between the two points on the metal chain, thereby providing another failsafe line which prevents the elastomeric element(s) from extending too far.

In such embodiments it will be appreciated that the continuous metal chain then acts as a last resort in the event that the other failsafe cable also fails.

As is mentioned above, the at least one elastomeric element is arranged so that it stretches in order to absorb at least a fraction of the normal tensile loads on the mooring line and this helps to reduce the peak loads on the mooring line. The peak loads may, for example, be reduced by more than 50%. The reduction in peak loads that is achieved may be dependent on the number of elastomeric elements, the type of elastomeric elements and/or the lengths to which they are allowed to stretch before reaching the predetermined length. The skilled person will understand, for example, how to choose an initial length and thickness of an elastomeric element based on the device being moored, material properties and the expected sea states. The reduction of peak loads on the mooring line may help to reduce fatigue on the mooring line thus potentially increasing the lifetime of the mooring line. This is particularly advantageous with mooring lines which are used to moor objects in remote environments such as those at sea. Mooring lines used in offshore environments are often expensive to produce and also expensive to maintain or replace.

The predetermined length of the bypass section of metal chain and the tensile response of the elastomeric element(s) ultimately determine the loads that the elastomeric element(s) is able to absorb. For instance, one example of an elastomeric element has an initial length of 4.5 m, the bypass section of metal chain has a length of approximately 10.25 m, and thus the elastomeric element is capable of stretching by around 125% before the metal chain transmits any tensile load. Typical elastomeric elements may be capable of extensions of up to ~400-500% without risk of failing, but may age when repeatedly extended to this limit by frequent cycles of use, for example due to the formation of microcracks in the elastomeric material. In a mooring line located in the ocean, for example, the elastomeric element(s) may be stretched by 3-4 million cycles a year and hence it is important to keep the maximum extension low enough to avoid long term damage. In a set of embodiments the initial length of the at least one elastomeric element, or the distance between the two attachment points on the metal chain, is chosen such that the elastomeric element is capable of extensions of at least 80%, 90%, 100%, 110%, 120%, 130%, 140%, 150%, 160%, 170%, 180%, 190% or 200% before reaching the predetermined length. On the one hand, relatively large extensions e.g. >100% ensure that the elastomeric element(s) is able to absorb a significant range of tensile loads before transferring any further tensile load, greater than the threshold tensile load, to the metal chain. By absorbing a large range of tensile loads, the at least one elastomeric element helps to significantly reduce the peak loads in the mooring line. On the other hand, it is beneficial to limit the extension range of the elastomeric element(s) so as to ensure that lifetime is not compromised. The Applicant has found that a good balance may be achieved by choosing the initial length of the at least one elastomeric element, or the distance between the two attachment points on the metal chain, such that the elastomeric element is limited to extensions of around 150%.

A further consideration is the way in which the at least one elastomeric element is attached to the metal chain. The at least one elastomeric element may be moulded around metal inserts at both ends so as to form a component of the attachment points. Such a moulded design allows for a much higher level of elongation and much higher loads than could typically be held by a crimped, clamped, or knotted elastomeric element. It also allows for ease of connection with a standard shackle to the rest of the mooring line. Preferably the at least one elastomeric element is moulded around a metal connector at each end. The surface area of the metal to elastomer surface is an important factor in maximum load handling capability and in lifetime consideration. The metal to elastomer bond at this surface can be affected by high elongations, as the volume of elastomeric material is stretched. By limiting the elongation experienced when the elastomeric element(s) stretch to the predetermined length of the bypass section of metal chain, as outlined above, a balance between material volume and performance can be achieved.

Alternatively, or in addition, in a set of embodiments the predetermined length of the section of metal chain between the two points of attachment may be chosen such that it is at least 1.5 times greater than the initial length of the at least one elastomeric element, preferably at least double the initial length of the at least one elastomeric element, and further preferably at least 3, 4 or 5 times longer than the initial length of the at least one elastomeric element. This means that the at least one elastomeric element will undergo significant elongation before reaching the predetermined length at which the section of the metal chain between the two points of attachment becomes taut. This increases the range of tensile loads that are absorbed by the elastomeric element(s) and thus the overall load reduction that can be achieved as compared to a traditional catenary mooring line consisting of metal chain alone.

As is mentioned above, the at least one elastomeric element provided by the mooring line allows for a range of the typical tensile loads applied to the mooring line to be absorbed by elongation of the elastomeric element(s) to a second length below the predetermined length so that the section of the chain between the two points of attachment remains slack. The initial length of the at least one elastomeric element is preferably substantially less than the predetermined length so that the elastomeric element(s) must stretch before the bypass section of chain becomes taut, so as to optimise the load reduction achieved. In some embodiments the initial length of the at least one elastomeric element may not be significantly less than the predetermined length if, for example, the elastomeric element(s) is not taut when it is attached between the two points on the metal chain. However, this would mean that initial tensile loads are absorbed by the two attachment points moving apart without a restoring force from the elastomeric element(s) being transmitted along the mooring line, reducing the benefit provided by the elastomeric element(s). It is therefore preferable that the initial length of the at least one elastomeric element is chosen so that the at least one elastomeric element is taut when attached between the two points on the metal chain. The initial length may be chosen, for example, based on the starting loads on the mooring line (e.g. due to the weight of the metal chain) and the elastic response of the elastomeric element(s). Shock protection is ensured by keeping the elastomeric element(s) taut at the initial length.

As follows from the discussion above, it is preferable that the mooring line is designed such that the at least one elastomeric element never reaches an elongation close to its elastic limit before the threshold tensile load is applied. Beyond the elastic limit of a material, permanent deformation will occur. The elastic limit, also known as the yield strength, is therefore the lowest stress at which permanent deformation is measured. When choosing the at least one elastomeric element to be attached to the metal chain it is preferable to ensure that the elastic limit is significantly greater than the threshold tensile load. This ensures that the elastomeric element will be able to repeatedly stretch to the predetermined length with minimal micro crack formation. Otherwise micro cracks can form which, over repeat elongations, can merge and grow, thereby limiting the lifetime of the elastomeric element. Choosing an elastic limit which is significantly greater than the threshold tensile load is also important as, over time, the elastomeric element(s) may deteriorate due to damages caused by the harsh environments that mooring lines are often used in (e.g. attack by ocean bio-organisms, shark bites, etc.). Deterioration of the elastomeric element(s) may cause the elastic limit to be reduced with age. Selecting an elastomeric element(s) with a significantly larger elastic limit means that even if the elastomeric element(s) deteriorates its yield strength is still unlikely to drop below the threshold tensile load.

However the elastic limit of the at least one elastomeric element does not need to be very high, in absolute terms, as the bypass section of metal chain takes over transmission of loads once the predetermined length is reached. Preferably the elastic limit (or breaking load) of the at least one elastomeric element is substantially less than the yield strength (or breaking load) of the metal chain. For example, the elastic limit (or breaking load) of the at least one elastomeric element may be about 50% or less than the yield strength (or breaking load) of the metal chain.

Ensuring that the elastic limit is greater than the threshold tensile load can be achieved in various ways. For example, if the distance between the two attachment points on the chain is already predetermined, the choice of the at least one elastomeric element can be made depending on the predetermined length of the bypass section of the metal chain relative to the initial length of the elastomeric element(s). The distance between the two attachment points may be predefined if the chain has certain links which make attachment easier, for example the shackles between shot lengths (discussed further below). Alternatively, if the initial length of the at least one elastomeric element and its rate of elongation is already predetermined, the distance between the points of attachment on the metal chain can be adjusted such that the threshold tensile load at which the chain takes the rest of the load is below the elastic limit. This may, for example, be achieved by bringing the attachment points closer together and thus reducing the predetermined length to which the elastomeric element(s) stretches before the metal chain becomes taut.

In order to provide a stress-strain response that is tailored to respond to the most frequent tensile loads which are applied to a given mooring line, e.g. taking into consideration its expected marine environment, the at least one elastomeric element may comprise at least one tensile element and/or at least one compressive element. What is meant by a tensile elastomeric element is an elastomeric element that stretches and elongates in response to an increase in tensile load. What is meant by a compressive elastomeric element is an elastomeric element that compresses and shortens in response to an increase in tensile load. An example of a compressive elastomeric element is an elastomeric element mounted between end connectors that are arranged to move closer together in response to a tensile load pulling the end connectors in opposite directions. Some examples of tensile and compressive elastomeric element are seen in the applicant's earlier publication WO 2012/127015, the content of which is hereby incorporated by reference.

In a first set of embodiments the at least one elastomeric element comprises one or more tensile elastomeric elements. In such embodiments the tensile elastomeric element(s) may be formed of a relatively soft material. For example, the tensile elastomeric element(s) may have a relatively low stiffness, such as an elastic modulus of 10 MPa or less. In these examples the tensile elastomeric element(s) may have an elastic modulus of at least 1 MPa, 2 MPa, 3 MPa, 4 MPa, 5 MPa, or 6 MPa (measured, for example, at 75% elongation). Such tensile elastomeric elements are appropriate for mooring lines which experience repetitive cyclic low loads. Tensile elastomeric elements may be chosen as they are capable of delivering a smooth response and typically have a long lifetime.

In a second set of embodiments the at least one elastomeric element comprises one or more compressive elastomeric elements, preferably in combination with at least one tensile elastomeric element. In such embodiments the compressive elastomeric elements may be formed of a relatively stiff material, such as an elastic modulus of at least 10 MPa (measured, for example, at 60% elongation). In these examples the compressive elastomeric element(s) may have an elastic modulus of at least 15 MPa, 20 MPa, 25 MPa, 30 MPa, or greater, especially towards the end of its compression range. Preferably such compressive elastomeric element(s) may provide a non-linear increase in elastic modulus with compression, meaning that an element becomes much stiffer towards the end of its compression range. This response can provide a bridge that matches the stiffness of the metal chain so that the mooring line does not experience a sharp change in load response that can result in a snatch load. As is described in WO 2012/127015, a suitable compressive elastomeric element may comprise a cylindrical corrugated or bellowed member formed of elastomeric material. The typical structure of compressive elements means that a relatively small amount of material is required to provide high protection and this contributes to reducing the overall weight of the mooring line.

In addition, or alternatively, in a set of embodiments the at least one elastomeric element may be arranged to provide a non-linear response to the tensile loads applied to the mooring line. It will be appreciated that there are various ways that a non-linear stress-strain response can be achieved. In preferred embodiments where the mooring line comprises a single elastomeric element, whether a tensile or compressive element, the elastomeric element may include a plurality of different sections along its length comprising different elastomeric materials and/or thicknesses of elastomeric material. In less preferred examples where the mooring line comprises a plurality of elastomeric elements, whether tensile and/or compressive elements, there may be provided a plurality of different elastomeric elements. The plurality of elastomeric elements may comprise different elastomeric materials and/or thicknesses of elastomeric material and/or lengths of elastomeric material. However increasing the number of elastomeric elements may unduly increase the complexity and cost of the mooring line. In a preferred set of embodiments the at least one elastomeric element comprises a single tensile elastomeric element, optionally in combination with a single compressive elastomeric element. Preferably the tensile and compressive elastomeric elements are arranged to respond in parallel to tensile loads when combined. However, it is further preferable that the compressive elastomeric element has a higher elastic modulus than the tensile elastomeric element. This means that the two elements contribute to substantially different parts of the overall stress-strain response of the mooring line. By selecting the combination of tensile elastomeric element(s) and compressive elastomeric element(s) it is possible to provide a non-linear stress-strain response that is tuned to respond to a wide range of movements of an object being moored. However a single elastomeric element has been found to deliver the lowest cost solution with least chance of entanglement.

In various embodiments the at least one elastomeric element may be formed of any suitable elastomeric material.

An elastomer is any polymer material with viscoelasticity (having both viscosity and elasticity) provided by very weak inter-molecular forces, therefore generally having high failure strain compared with other elastic materials. The elastomeric material may be a thermoset (requiring vulcanization e.g. natural or synthetic rubber) or a thermoplastic (e.g. thermoplastic polyurethanes (TPU), thermoplastic copolyesters, thermoplastic polyamides, thermoplastic olefins). In those embodiments where the at least one elastomeric element comprises a tensile elastomeric element, such a tensile elastomeric element preferably consists of a natural rubber material. Natural rubber may be chosen for its excellent lifetime performance. This results from the self-healing properties of natural rubber, as opposed to synthetic rubber materials, which allow for micro-cracks to heal rather than proliferate. In those embodiments where the at least one elastomeric element comprises a compressive elastomeric element, such a compressive elastomeric element may consist of a thermoplastic material. An example of a suitable thermoplastic elastomeric material is Hytrel from Du Pont.

A mooring line according to the present invention generally allows an object which is being moored to move spatially. It will be appreciated by those skilled in the art that mooring lines in accordance with the present invention may form part of a variety of different mooring systems. In some examples, the mooring line may be part of a taut mooring system, i.e. a mooring system in which the metal chain outside the two points of attachment is held taut. In such examples the movement of the moored object may be facilitated solely by the at least one elastomeric element stretching until the bypass section of metal chain between the two points of attachment becomes taut. Once the at least one elastomeric element is stretched to the predetermined length and the bypass section of chain becomes taut, the object is no longer able to move any further. Such mooring lines may be suitable for near shore or tidal environments where a relatively small and well-defined range of movement is required.

Alternatively the mooring line may form part of a catenary mooring system. A catenary mooring system typically consists of a first section of metal chain resting along the floor along with a second section of metal chain connecting the first section to the object being moored. A mooring line according to the present invention may be inserted into the second section of metal chain so as to provide a load reduction. In particular, the most frequent and generally low tensile loads may be absorbed by the at least one elastomeric element rather than by repeatedly lifting the first section of metal chain off the floor. This effectively converts a traditional catenary mooring line into a semi-taut mooring line and eliminates some of slack within the chain. Reducing the amount of slack chain helps to reduce wear on the chain thus improving the operational life of the mooring line. Improving the operational life is a significant benefit as mooring lines are often used in remote marine environments where replacing the mooring lines is extremely expensive not only due to the cost of the mooring lines themselves but also due to the resources required to replace the mooring lines.

As the elastomeric element reduces the loads in a catenary mooring system, this allows the total length or grade (e.g. thickness or weight per link) of metal chain to be reduced. The weight of chain along the seabed floor available to be lifted is proportional to the expected maximum loads (taking into account the holding power of the anchor). Reducing the maximum peak loads dramatically reduces the length and weight of chain required on the seabed floor, as well as the anchor requirement. This also means that as less chain rests on the seabed floor, the footprint of the mooring system can be reduced. Typically the quantity of metal chains used in catenary mooring systems is extremely expensive; reducing their overall length potentially provides a significant cost reduction. This is augmented by the fact that a relatively small length of elastomeric element can enable a relatively large length of metal chain to be removed.

In embodiments where the mooring line is part of a catenary mooring system it will be appreciated by those skilled in the art that the mooring line is capable of absorbing the tensile loads, both by stretching the at least one elastomeric element and/or lifting the metal chain off the floor. It will be appreciated that whether the metal chain is caused to lift off the floor will depend on the magnitude of the tensile load applied and the rate at which it is applied. A benefit of the elastomeric element(s) is its absorption of shock loads.

Thus according to a second aspect of the present invention there is provided a catenary mooring system comprising a floating body and a mooring line comprising a first section of metal chain resting on the floor and a second section of metal chain connecting the first section of metal chain to the floating body, and further comprising at least one elastomeric element having an initial length that is attached between two points of attachment on the second section of metal chain, thereby defining a third section of metal chain between the two points of attachment of the at least one elastomeric element with a predetermined length that is greater than the initial length of the at least one elastomeric element;

wherein the third section is directly linked to the second section by chain links so as to transmit a tensile load directly from the second section of the metal chain to the third section;

wherein the at least one elastomeric element is arranged such that:

when an initial tensile load, below a threshold tensile load, is applied to the mooring line in use, the at least one elastomeric element stretches from the initial length, to a second, longer, length wherein the third section of metal chain between the two points of attachment is not taut and thus the initial tensile load is transmitted from and to the second section of metal chain through the at least one elastomeric element; and when a further tensile load equal to or above the threshold tensile load is applied to the mooring line in use, the at least one elastomeric element stretches further from the second length to the predetermined length wherein the third section of metal chain between the two points of attachment becomes taut, and thus the further tensile load applied to the mooring line is transmitted directly from and to the second section of metal chain through the third section of metal chain.

It will be appreciated by those skilled in the art that a floating body may not necessarily be a body which is floating on the water's surface. The body may be partially submerged or fully submerged and still be considered to be floating. Any floating body that is supported above the floor by water is considered to be a floating body which may require a mooring line.

Typically the metal chain in a catenary mooring system comprises several lengths or sections of metal chain attached together. Whilst the entire mooring line may comprise a single type (e.g. thickness) of metal chain, often two different chains are connected in series. Therefore, in a set of embodiments the mooring line comprises a plurality of different metal chains, or different sections of metal chain, connected in series, preferably a plurality of different thickness metal chains or sections of metal chain. This is often the case with catenary mooring systems where the overall chain length is often very large and of the order of kilometers. In such mooring systems often a length of heavy gauge chain which rests along the floor is attached to a smaller gauge chain which connects the heavy gauge chain resting along the floor to the moored object. Accordingly the first section of metal chain may be thicker than the second section of metal chain.

As the mooring lines in catenary systems are relatively long, as is discussed above, they typically comprise a plurality of sections of chain connected in series. Typically each section of metal chain is referred to as a shot length. Each of these shot lengths is often connected to the adjacent shot length using a shackle or chain link which is welded closed. It is important that the shackle or link is formed from the same grade and strength material as the chain itself. This ensures that these points of connection do not form a weak point in the chain. In a set of embodiments the metal chain comprises a plurality of shot lengths connected in series. In such embodiments the attachment points of the at least one elastomeric element are preferably located at each end of one shot length. In other words, the predetermined length of the third section of chain may correspond to a shot length. It will be appreciated that the metal chain may be formed from a variety of different types of chain, for example, a stud-less chain and/or a stud-link chain. Also the mooring line may comprise multiple shot lengths, potentially with different shot lengths of different grades along the length of the mooring line.

The metal chain used in mooring systems is typically stud-link or stud-less. Stud-link chain has a bar across the width of the links which makes it difficult to attach a connector to it. Many heavy duty chains are stud-link as it is heavier. Metal chain comes in pre-determined lengths of 27.5 m (a shot length) which are then welded together (or shackled) and it makes sense to connect to these points, or to cut the chain and replicate such a connection. Preferably the third ("bypass") section of metal chain has the same specification as the second section of the chain in the mooring line so that it does not form a weak point once the third section is taut. This means that, even if the at least one elastomeric element becomes disconnected, the entire mooring line forms a typical chain line with no weak points.

Whether or not the mooring line forms part of a catenary mooring system, it will be appreciated by those skilled in the art that connecting the at least one elastomeric element directly to the chain may not always be possible. Whether it is possible to directly attach the at least one elastomeric element may depend on the size, gauge and type of metal chain e.g. there may not physically be space in the internal hole of the chain links to directly attach the at least one elastomeric element, especially for a stud-link metal chain. This problem may be further increased in embodiments where a plurality of elastomeric elements is attached to the metal chain.

To form the attachment points, it may be possible to cut a stud-link chain at the desired point and attach the elastomeric element(s) with shackles or through welding in a stud-less link of similar strength. However, in a preferred set of embodiments the at least one elastomeric element is attached to the metal chain at each attachment point by a connector. Whilst it is appreciated that this connector may, for example, take the form of a simple shackle which can attach the chain and the elastomeric mooring component directly together, it is appreciated that a shackle may not always be appropriate. In some embodiments the connector may comprise a chain clamp, especially if the chain is a stud-link chain. In a set of embodiments the connectors may be shaped such the (third) section of metal chain between the two attachment points defines a bypass section of chain that is not able to come in contact with the at least one elastomeric element at least when the bypass section of chain is taut. For example, a chain clamp may comprise a shoulder portion that extends between the elastomeric element and the bypass section of chain to prevent them from touching at the attachment point (at least when the bypass section of chain is taut). Such a shoulder portion may be positioned between first and second attachment points of the chain clamp. However the connectors are preferably shaped so as to provide an arrangement of three attachment points.

This is considered to be novel and inventive in its own right, and thus when viewed from a further aspect the invention provides a connector, for attaching at least one elastomeric element to a mooring line which comprises a metal chain, wherein the connector comprises a first attachment point for the elastomeric element, a second attachment point for a first section of the metal chain and a third attachment point for a second section of the metal chain, the attachment points being arranged such that when a tensile load is applied to the first section of metal chain, the connector aligns itself so that the tensile load is transferred along the at least one elastomeric element, and the second section of metal chain is not able to come into contact with the at least one elastomeric element at least when the second section of metal chain is taut.

By providing a connector to attach the at least one elastomeric element to the metal chain it means that the connector can be designed so that the elastomeric element is not directly attached to the metal chain. Additionally, by providing a connector that it designed such that the at least one elastomeric element and the second "bypass" section of metal chain are unable to come into contact with each other at least when taut (e.g. when a tensile load equal to or greater than the threshold tensile load is applied to the mooring line) ensures that the elastomeric element and the bypass section of metal chain do not rub against each other and cause wear problems. This helps to prevent reduction in the lifespan of the mooring line. As elastomeric elements are typically formed of a weaker material than metal chain, if they were to repeatedly come in contact with one another, the metal chain may damage the elastomeric element potentially causing it to break. Once the elastomeric element has been caused to break the mooring line is no longer capable of absorbing the tensile loads as efficiently. As discussed previously, ensuring a significant lifetime for a mooring line is important as mooring lines are typically placed in remote locations where replacement is often difficult and expensive.

In a set of embodiments the connector is shaped so as to pivot about the second attachment point. Accordingly each connector may comprise a first attachment point for the elastomeric element, a second attachment point for the metal chain and a third attachment point for the second ("bypass") section of chain, wherein the connector is shaped so as to pivot about the second attachment point. This means that the first section of metal chain can be generally aligned with the elastomeric element(s) while the second "bypass" section of chain is swung away from the elastomeric element(s). This may be achieved, for example, by an L-shaped or V-shaped connector comprising two substantially straight arms connected by a bend. Two of the three attachment points may, for example, be arranged at either end of the arms of the connector and the pivoting attachment point at the bend between the two arms. In some such embodiments the first attachment point is provided at the end of one arm, the second attachment point is provided at the bend between the arms, and the third attachment point is provided at the end of the other arm. The at least one elastomeric element may therefore be attached at one end of the L-shape or V-shape, and the metal chain may be attached at the other end of the L-shape or V-shape and at the bend between the two arms. Attaching the at least one elastomeric element and the first and second sections of metal chain at these three spaced apart points ensures that the second "bypass" section of metal chain and the at least one elastomeric element cannot come into contact with each other at least when the second "bypass" section of metal chain is taut, e.g. when the threshold tensile load is reached. In an L-shaped connector, one arm may be longer than the other so as to maximise the distance of the third attachment point from the bend and hence increase the spacing between the "bypass" second section of chain and the elastomeric element(s). Additionally, by attaching the metal chain and the at least one elastomeric element in this way means that as the threshold tensile load is reached the connector acts as a lever which pulls the elastomeric element(s) to one side and brings the "bypass" second section of metal chain into a parallel arrangement. This means that the tensile load can be appropriately transferred along the metal chain from the first section to the "bypass" second section.

It will be appreciated that the primary purpose of the at least one elastomeric element attached to the metal chain is to assist in reducing the loads the mooring line experiences while retaining some of the traditional metal chain as a failsafe. It is therefore preferable that the connector is formed from a material which is as strong as the metal chain to which it is connected. Further preferably, the connector is made from substantially the same material as the metal chain. Forming the connector from the same material is advantageous as it ensures that there is even wear between the connector and the metal chain. If, for example, the connector was made from a stronger material it may wear on the metal chain forming a weak spot on the chain which may lead to it failing. Furthermore, forming the connector from a similar or the same metal as the chain may be important to prevent galvanic corrosion.

Whilst the connector connects the at least one elastomeric element and the metal chain together, it will be appreciated that it is still necessary to attach the connector to the metal chain and the at least one elastomeric element. This may be achieved by integrated connection means in the connector. Alternatively, in a set of embodiments the at least one elastomeric element and the metal chain are each attached to the connector by a shackle. The shackle is preferably of the same grade, thickness and size as the metal chain itself.

The present invention also extends to a method of modifying a mooring line which comprises a metal chain, the method comprising: attaching a first end of at least one elastomeric element to a first attachment point on the metal chain and attaching a second end of the at least one elastomeric element to a second attachment point on the metal chain, wherein the metal chain between the first and second attachment points has a predetermined length that is greater than an initial length of the at least one elastomeric element. This means that the predetermined length of metal chain between the first and second attachment points defines a "bypass" section of metal chain that is slack when the elastomeric element(s) is under tension at its initial length.

According to preferred embodiments of such a method, the metal chain is unbroken. However it is also envisaged that the method may further comprise: breaking the metal chain and inserting one or more chain links to allow for attachment of the at least one elastomeric element. For example, a link or section of a stud-link chain may be replaced with a link or section of a stud-less chain.

It will be appreciated that such a method can be used to modify a mooring line that is already in situ. For example, a catenary line comprising a metal chain being used to moor a buoy at sea may be modified using this method. According to embodiments of this aspect of the invention it is preferable that the metal chain is not broken during attachment of the elastomeric element. For example, the elastomeric element(s) may be attached by a connector or shackle as discussed above. In such embodiments the mooring line advantageously retains a continuous, unbroken, metal chain along its entire length as a failsafe in the unlikely event of failure of the elastomeric element(s). It is therefore preferable that the "bypass" section of the metal chain between the first and second attachment points is directly linked by chain links to the rest of the metal chain so as to form a continuous metal chain for the mooring line. Preferably at least one, and preferably both, of the two attachment points is not at the end of the metal chain in the mooring line. In other words, the predetermined length of the bypass section of the metal chain is shorter than the total length of the metal chain in the mooring line.

Such methods of modifying the mooring line require that the predetermined length of the chain between the attachment points is longer than the initial (e.g. unstretched) length of the elastomeric element(s). It will be understood that in order to attach the elastomeric element in such a manner the "bypass" section of chain between the attachment points may to be gathered such that the physical distance between the attachment points allows the elastomeric element to easily be attached. This may, for example, be achieved by physically grouping a section of the chain together so that the tension on the chain is released and then attaching the elastomeric element(s) at the two points of attachment and then allowing the tension to be re-applied and thus transferred along the elastomeric element(s). Such a method is advantageous as it means that the object that is being moored, for example at sea, is not released from the mooring line and thus reduces the risk of it becoming detaching and floating away from its ideal position. This method may also be appropriate when the mooring line comprises a catenary line—in such an example it may be possible to bunch together a section of the chain as a small section of chain can be lifted away from the sea floor to account for this bunched section.

Alternatively, the at least one elastomeric element may be stretched to a certain extension and then attached to the metal chain, with the length of the stretched element and the bypassed section of chain to which it is being attached being the same. Attaching the elastomeric element in this way effectively establishes the elastomeric element in a fully stretched state that matches the predetermined length of the bypassed section. The elastomeric element(s) may then reduce in length and slack may be taken from the rest of the metal chain to allow for this. Attaching the elastomeric element in this way may be advantageous in cases where it is particularly difficult to bunch and hold the chain together whilst the elastomeric element(s) is being attached.

However, it will be appreciated that modifying a mooring line in a way as described above may not always be suitable, particularly in situations where there may not be sufficient slack chain. Therefore, in an alternative set of embodiments the method comprises temporarily detaching the mooring line from the object to which it is attached. This allows a section of the chain to easily be gathered and the elastomeric element(s) attached. This method may be preferable when the object is moored by a plurality of mooring lines and thus detaching a single mooring line has minimal effect on the security of the moored object.

Whilst it is possible to add at least one elastomeric element into an existing mooring line it may be easier to attach one or more elastomeric elements to a new mooring line. Thus in an alternative set of embodiments the method is applied to a new mooring line which is not yet attached to an object. Applying the method to a new mooring line is likely to be simpler than modifying an existing line as it is likely not to be in a hostile environment such as being at sea. Also when the mooring line is not in use there is no requirement to remove the tension on the mooring line in order to attach the elastomeric element(s).

While it is discussed that the metal chain typically comes into action during the use of the mooring line, it will be appreciated that in some situations the metal chain may never come into action, i.e. the at least one elastomeric element may be designed so as to take into account the full possible range of motion of the moored object. In such an embodiment the metal chain is there in the extremely unlikely event of failure of the elastomeric element(s), however it may not act to transfer tensile loads in any other situation other than the elastomeric element(s) breaking.

The invention has various applications, particularly in marine mooring, however it is appreciated that it is not limited to marine mooring situations. The mooring line according the invention may, for example, be used to moor: aquaculture farms, buoys, wind farms, tidal farms, wave farms, fenders used in ship-to-ship transfer or storage of mothballed ships. All of the examples given above typically involve expensive objects which are preferably securely moored. The present invention helps to reduce the loads experienced by the mooring lines mooring these objects and thus reduces the chance of these lines failing thus increasing the security of the moorings.

It will be appreciated a mooring line in accordance with the present invention can be used to moor a range of different objects in a range of different environments. For example, the mooring line may be used to moor objects at sea, in rivers, in lakes or in pools.

It will be appreciated that certain preferred features of the invention, which are, for clarity, described above in the context of separate embodiments, may also be provided in combination in a single embodiment. Conversely, various preferred features of the invention which are, for brevity, described in the context of a single embodiment may also be provided separately or in any suitable sub-combination.

Some preferred embodiments of the present invention will now be described, by way of example only, and with reference to the accompanying drawings, in which.

Figure 8A:
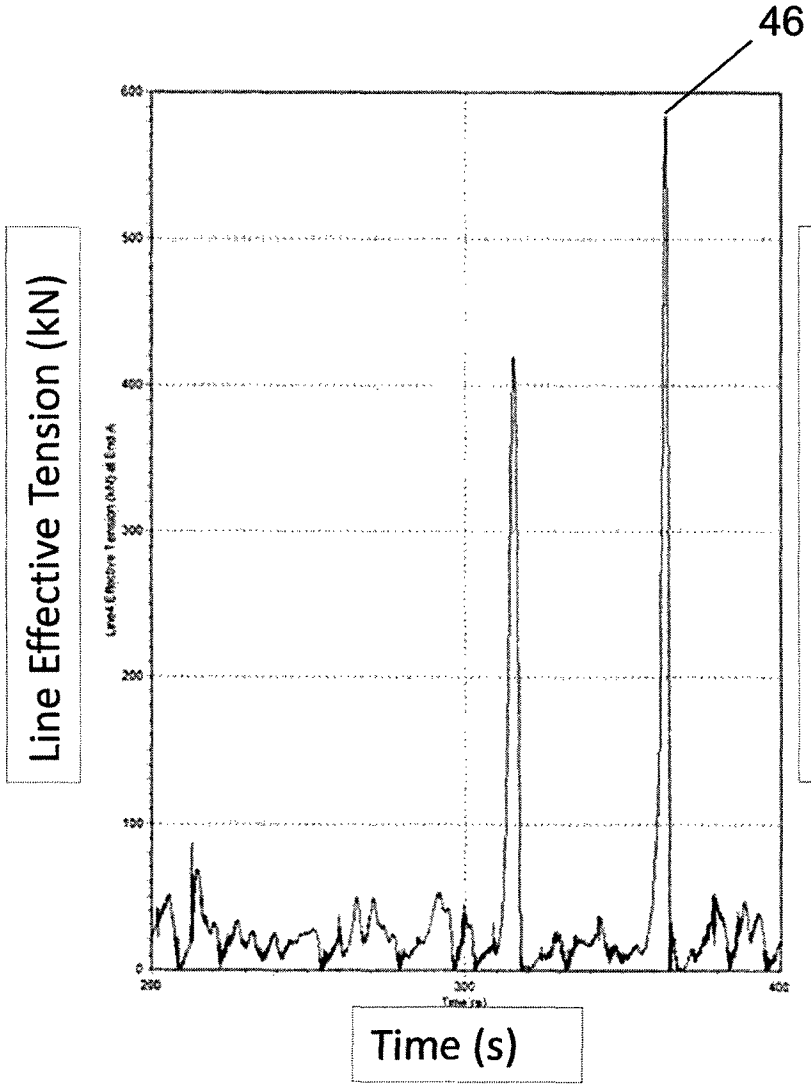
Figure 8B:
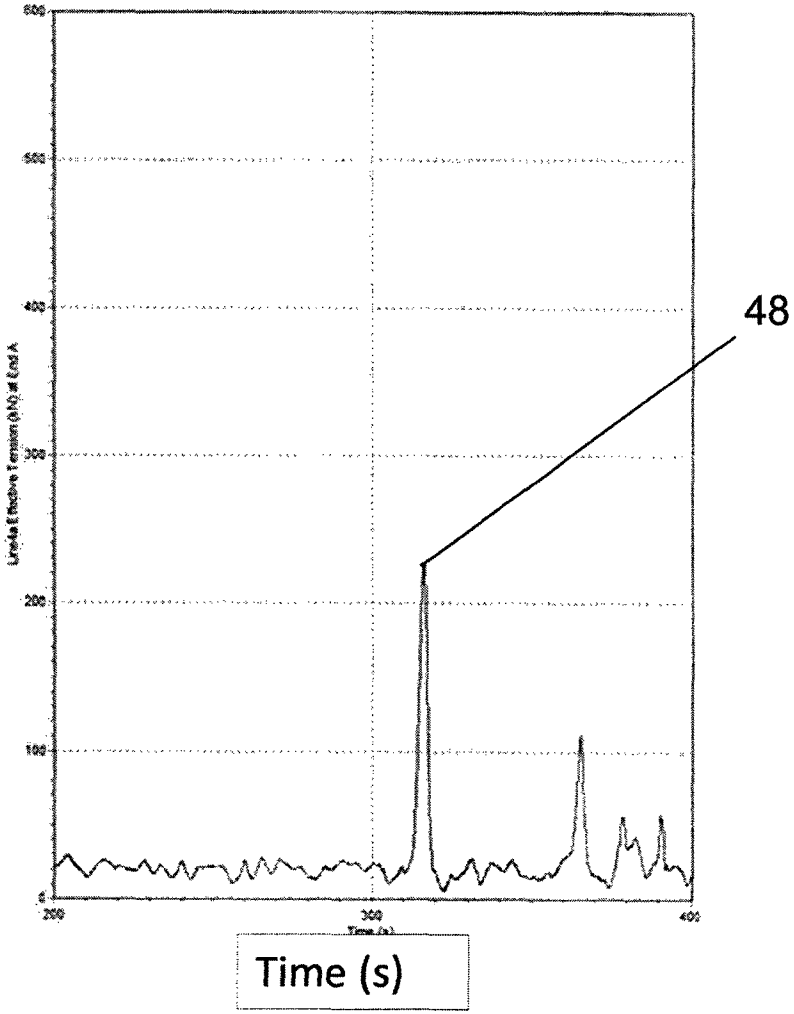
Figure 9:
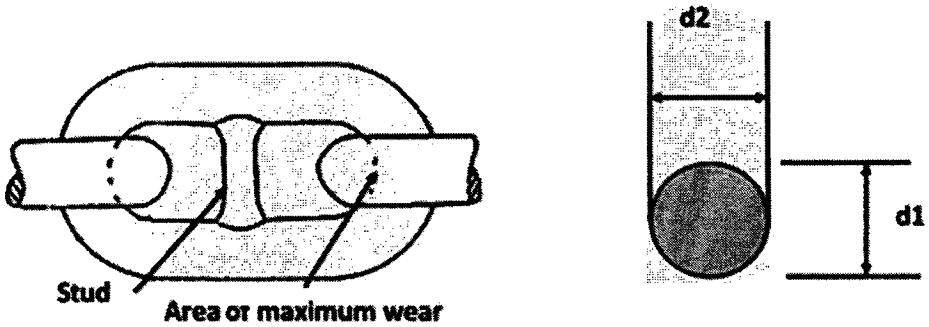
Figure 10B:
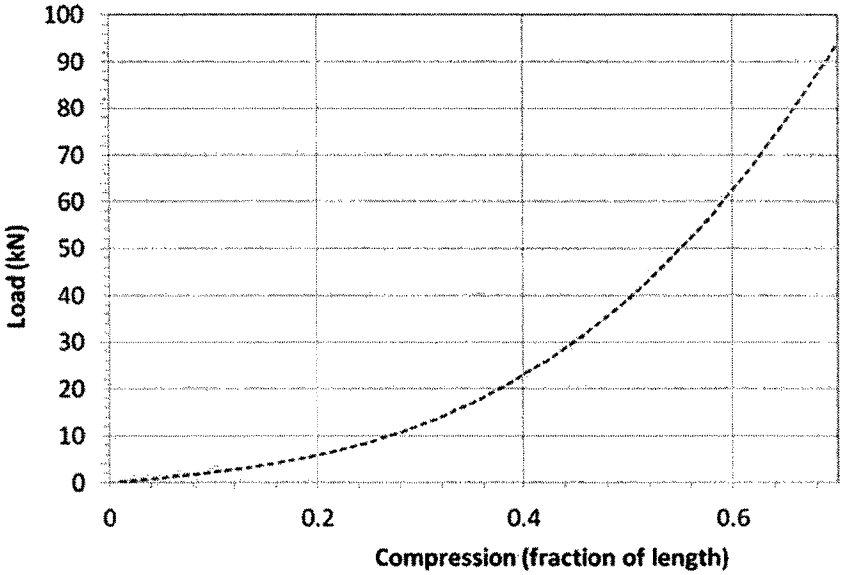
Figure 10A:
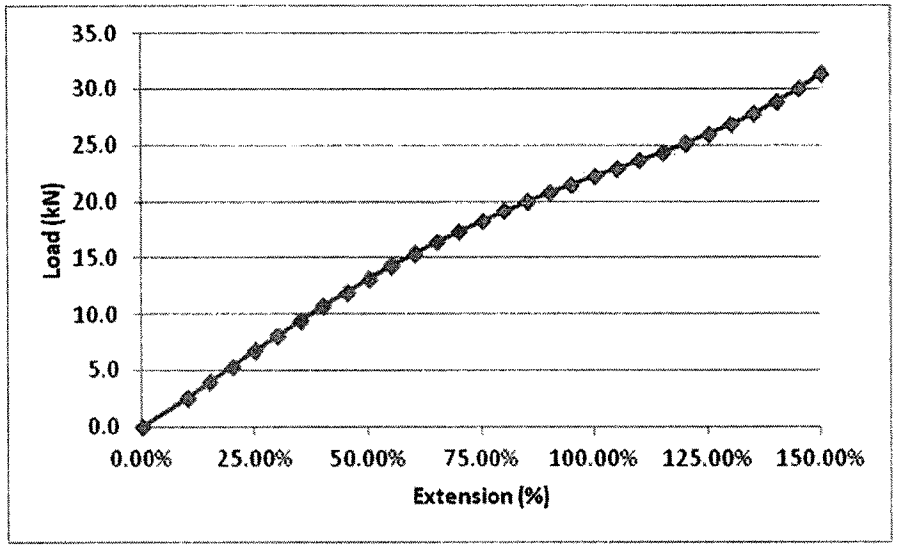
Figure 11:
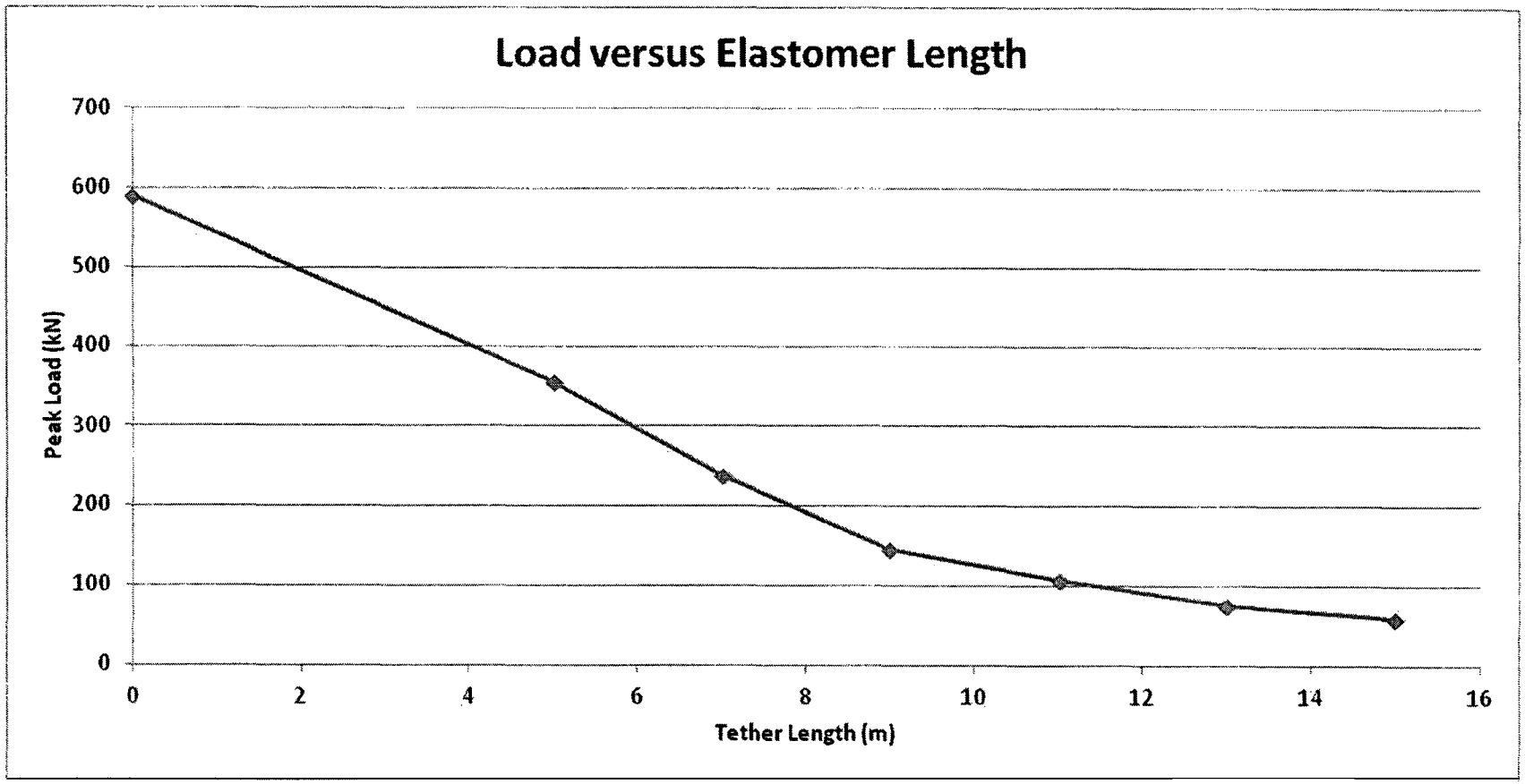
Figure 12:
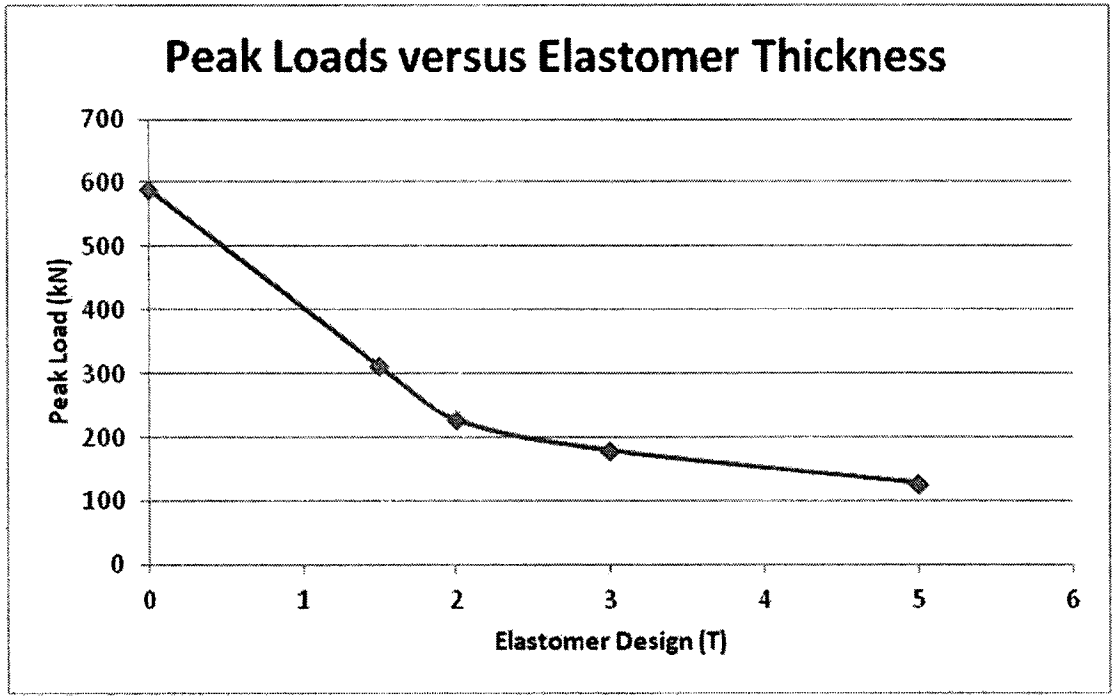
Figure 13:
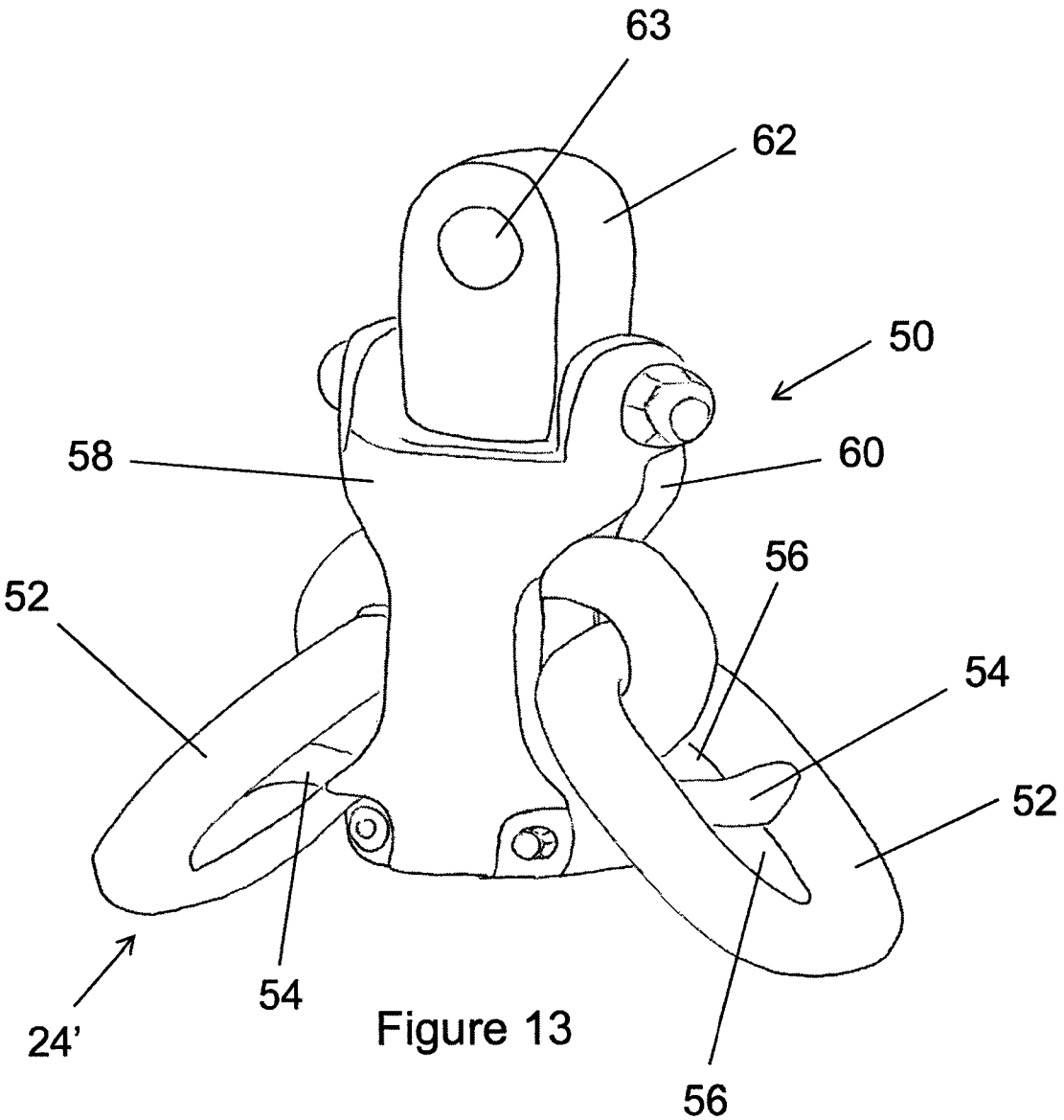
Figure 14A:
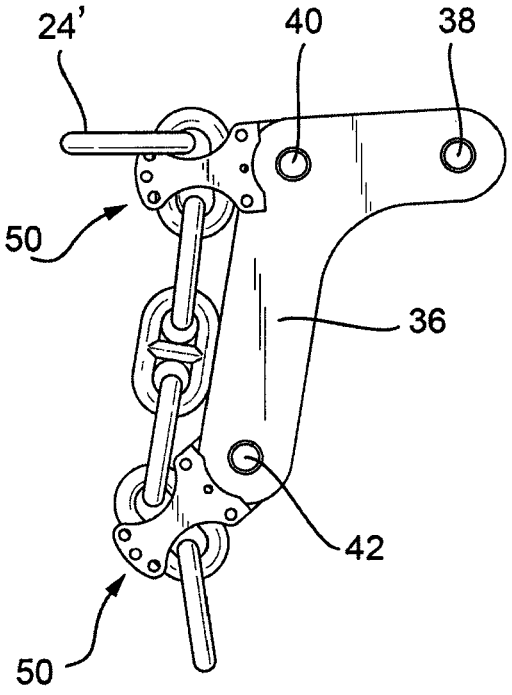
Figure 14B:
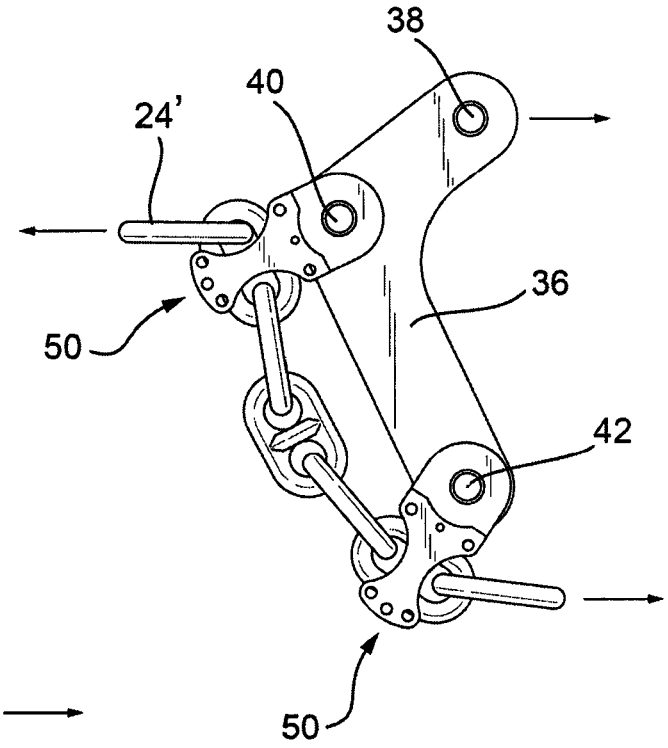
Figure 14C:
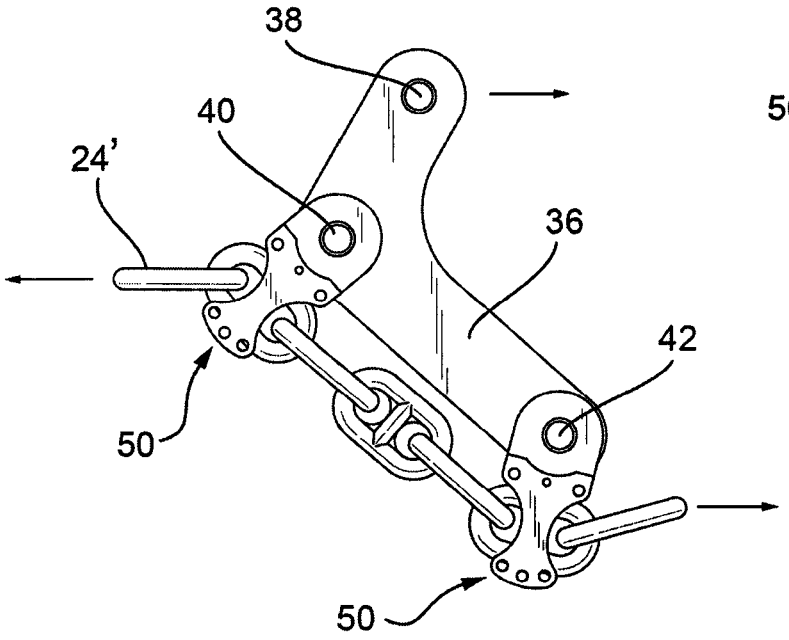
Figure 16:
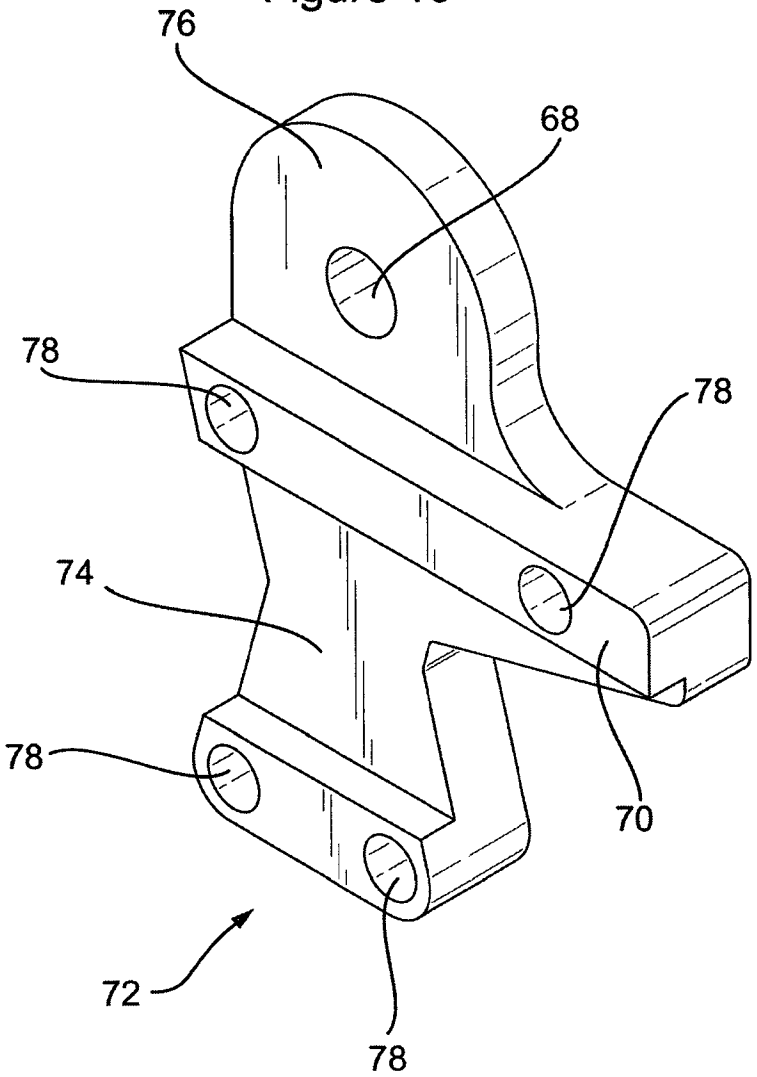
Figure 15:
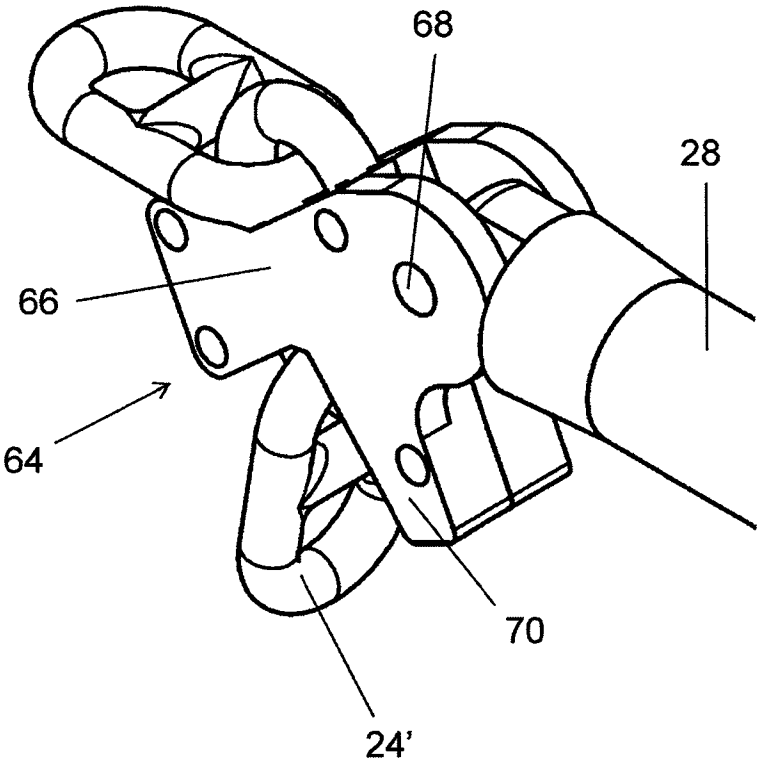

FIG. 8*a*-8*b* are two graphs comparing the peak loads experienced by a traditional mooring line to a mooring line in accordance with embodiments of the present invention;

FIG. 9 is an image of a link in a stud-link chain;

FIGS. 10*a*-10*b* are two graphs showing the stress-strain response of a typical elastomeric tensile element and a typical elastomeric compressive element;

FIG. 11 is a graph showing the impact of increasing the elastomeric element length on the peak loads experienced by a moored body;

FIG. 12 is a graph showing the impact of increasing the elastomeric element thickness on the peak loads experienced by a moored body;

FIG. 13 is an image of a typical chain clamp;

FIGS. 14*a*-14*c* illustrate the chain clamp seen in FIG. 13 being attached in a mooring line (not shown in full) with the mooring line being under different tensile loads;

FIG. 15 shows an alternative chain clamp;

FIG. 16 illustrates one half of the chain clamp seen in FIG. 15; and

Figures 17A, 17B, 17C:
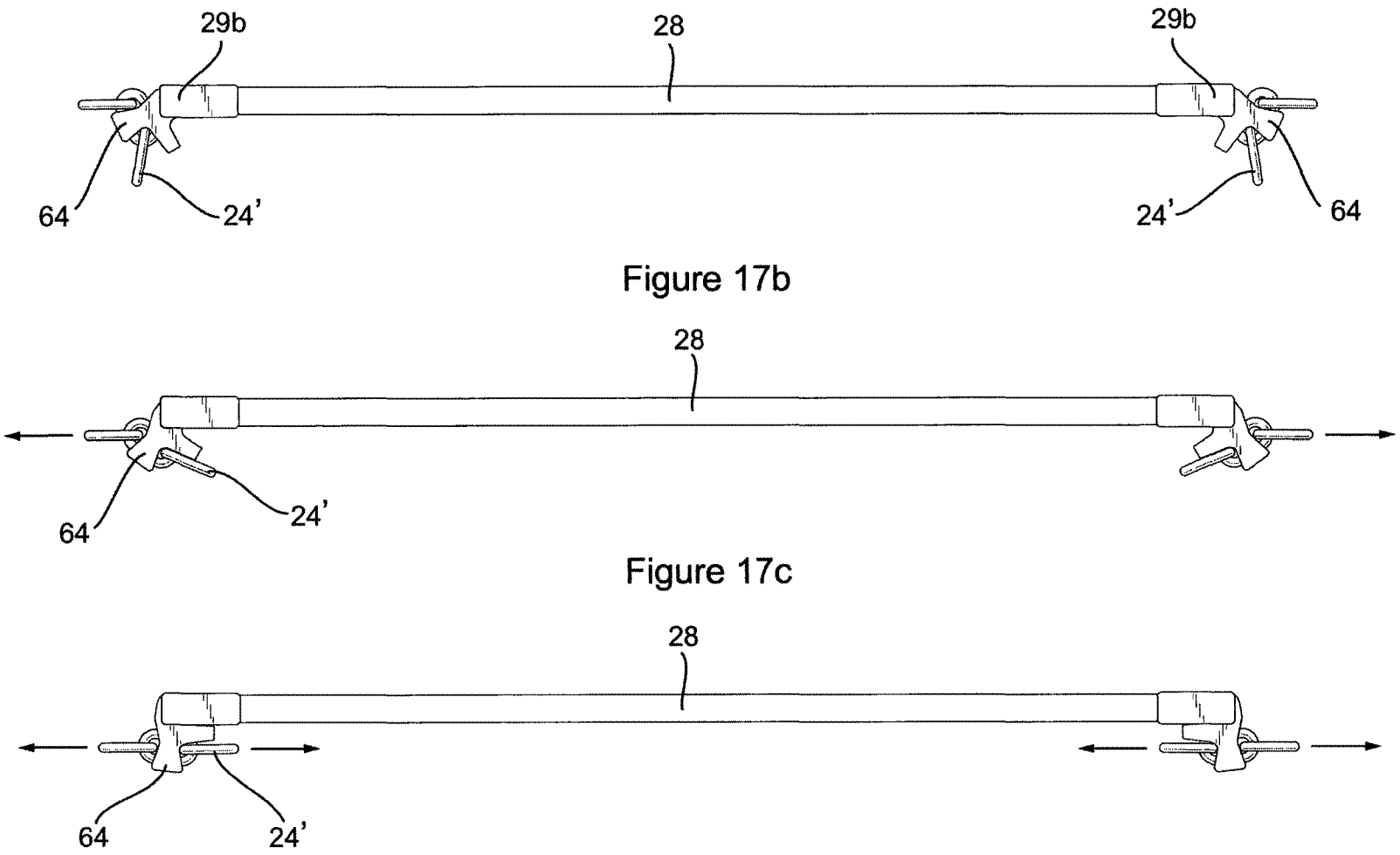

FIGS. 17*a*-17*c* illustrates the chain clamp seen in FIG. 15 being attached in a mooring line with the mooring line being under different tensile loads.

Figure 1:
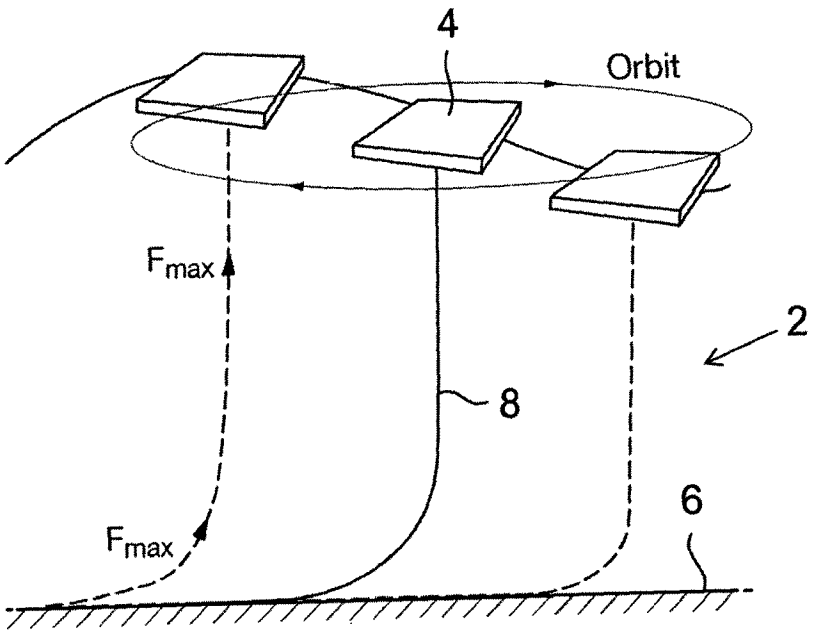
FIG. 1 is a schematic representation of a prior art catenary mooring system.

FIG. 1 depicts a conventional catenary mooring system 2. A floating platform 4 is connected to the seabed 6 by a catenary line 8. The catenary line 8 is typically formed of a plurality of shot lengths of metal chain. It can be seen from FIG. 1 that the circular motion of the platform 4 caused by the waves results in a large horizontal motion envelope for the mooring line 8 as it is picked up from the ocean floor 6. As the water depth increases due to large waves the catenary chain 8 is lifted off the seabed and the platform 4 moves upwards and to the left. For small waves, the chain 8 is laid along the seabed 6 as the water depth decreases and the platform 4 drifts downwards and to the right. Thus very large amounts of chain and a large space envelope is required to allow horizontal movement as water depths rise and fall. The mooring forces ($F_{max}$) are high and transmitted through the entire chain 8, experienced at all points.

Figure 2:
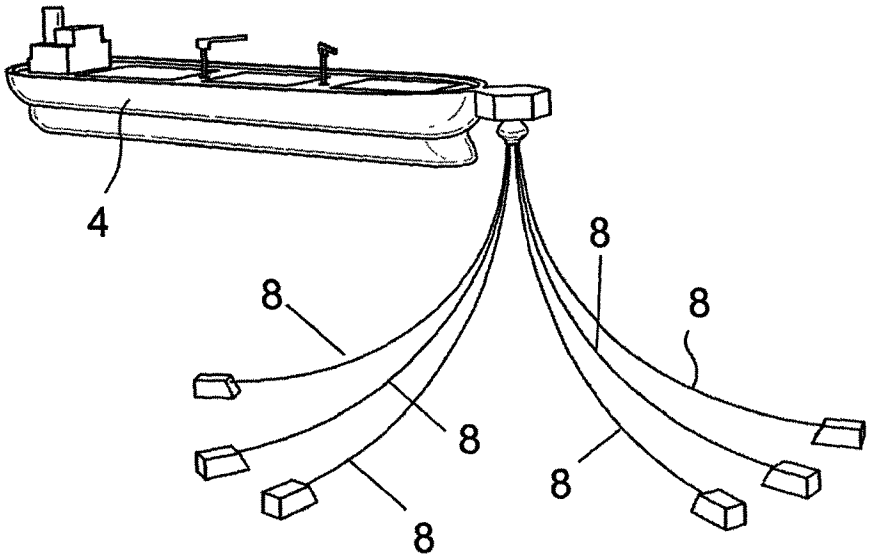
FIG. 2 is a schematic representation of a prior art catenary mooring system in which multiple catenary mooring lines are used.

FIG. 2 depicts a conventional catenary mooring system for a ship 4 in which several synthetic mooring lines or steel chains 8 are anchored to the seabed. It can be seen that the lines or chains must be long, e.g. up to 2 km, in order to cope with changes in water depth and to provide the required load along the surface of the seabed. The length of the chain 8 must provide sufficient weight to resist horizontal forces when the heavy ship moves, even on relatively small e.g. 5 m waves. As the chain 8 experiences high forces during the changes in water depth, multiple chains 8 are provided to reduce the load on any one chain 8 and also provide a failsafe in the case of failure of one of the chains 8.

Figure 3:
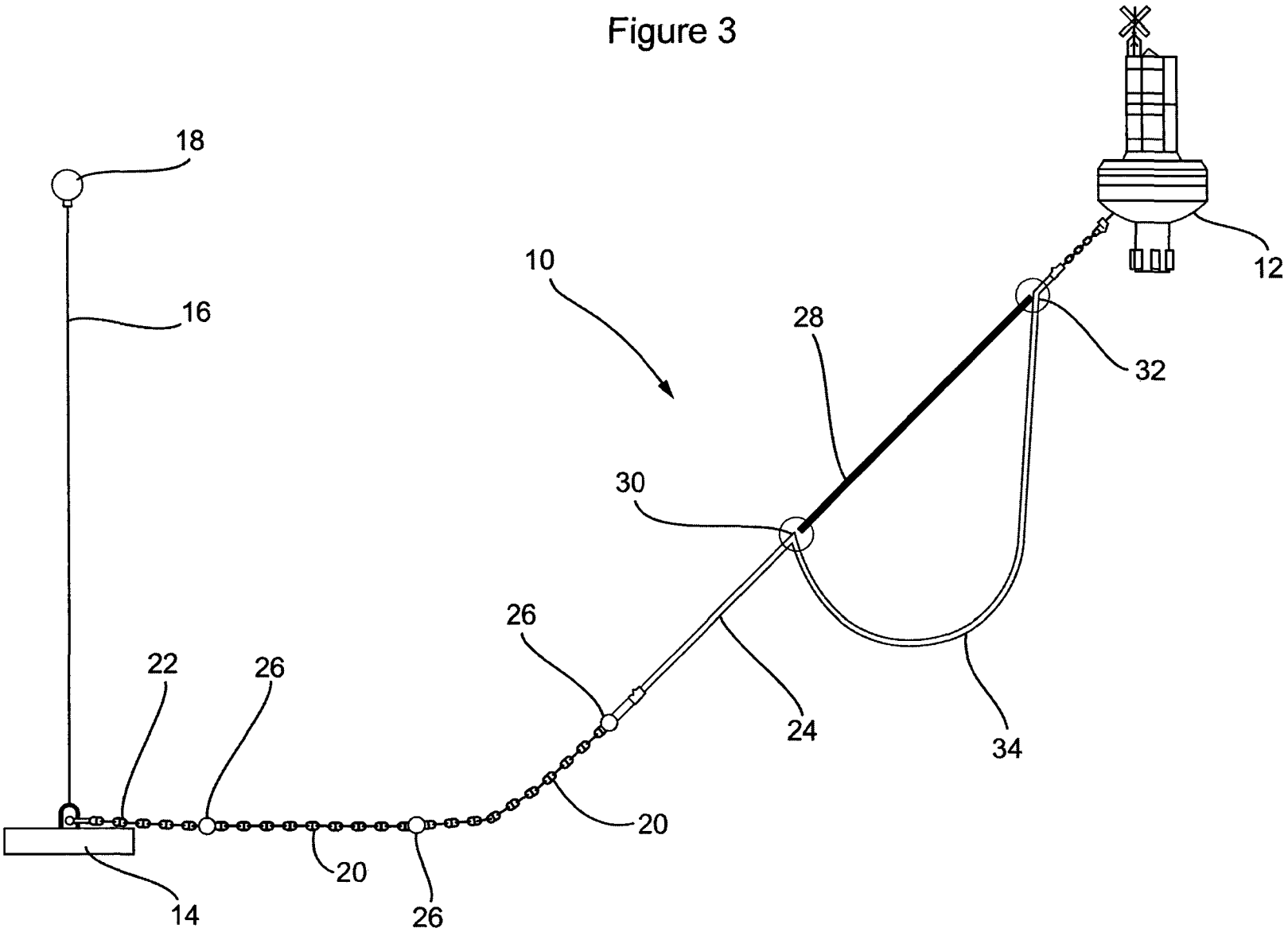
FIG. 3 is a schematic representation of a mooring line in accordance with an embodiment of the present invention.

FIG. 3 shows an embodiment of the present invention. FIG. 3 shows a mooring line 10 connecting a floating body 12 to an anchor 14 on the seabed. The anchor 14 comprises a line 16 and float 18 for identifying the location of the anchor 14. The mooring line 10 is a catenary mooring line comprising two shot lengths of 38 mm steel chain 20 attached to a shorter, sinker chain 22 which is attached to the anchor 14. Attached to the end of the second shot length of 38 mm chain 20 is a length of 28 mm steel chain 24 which is connected to the floating body 12. Attaching the shot lengths of 38 mm chain 20 to the sinker chain 22 and to the 28 mm chain 24 are 38 mm shackles 26. It can be seen from FIG. 3 that the shot lengths of the 38 mm chain 20 and the sinker chain 22 rest on the seabed.

Attached in parallel with a section of the 28 mm chain 24 is an elastomeric element 28 having an initial length in its unstretched state. The elastomeric element 28 is attached to the 28 mm chain 24 at a first point 30 and a second point 32 such that a "bypassed" chain section 34 of the 28 mm chain 24 between the attachment points 30, 32 is longer than the initial length of the elastomeric element 28. The "bypassed" chain section 34 is therefore slack while the elastomeric element 28 is taut. In one example, the elastomeric element 28 has an initial i.e. unstretched length of 4.5 m and the "bypassed" chain section 34 between the attachment points 30, 32 has a length of about 10.25 m. As the floating body 12 rises and lowers due to changes in the sea depth (e.g. tidal or wave motion), a tensile load is transmitted along the 28 mm chain 24. If there is a sudden change in depth of the water, this load increase is transferred into the elastomeric element 28 causing it to stretch. This allows the floating body 12 to rise with the increased water depth, without transferring shock loads to the steel chains 20, 24. Depending on the elasticity of the elastomeric element 28 and its initial length relative to the bypassed section of chain 34, after a certain extension the chain 34 will become taut and further tensile load will be transmitted along the 28 mm chain 24. Accordingly, as the floating body rises it may also cause the length of 38 mm chain 20, 22 on the seabed to be lifted away from the seabed. This provides a restoring force such that when the sea level lowers, the floating body 12 also lowers and remains securely moored. In the example mentioned above, the bypassed section of chain 34 is only taut once the elastomeric element 28 stretches by 125% or more.

The length and/or elasticity of the elastomeric component may be chosen such that the 38 mm chain 20, 22 on the seabed is only caused to lift when the elastomeric element 28 has been fully extended to just below its elastic limit. Whilst this may be the case in some embodiments, it is preferable that the length and/or elasticity is chosen such that the 38 mm chain 20, 22 lifts before the elastomeric element 28 is fully extended, i.e. well before reaching its elastic limit. This ensures that the elastomeric element 28 is safely operational, and can assist in reducing shock loads, at a range of different sea depths.

Figure 4:
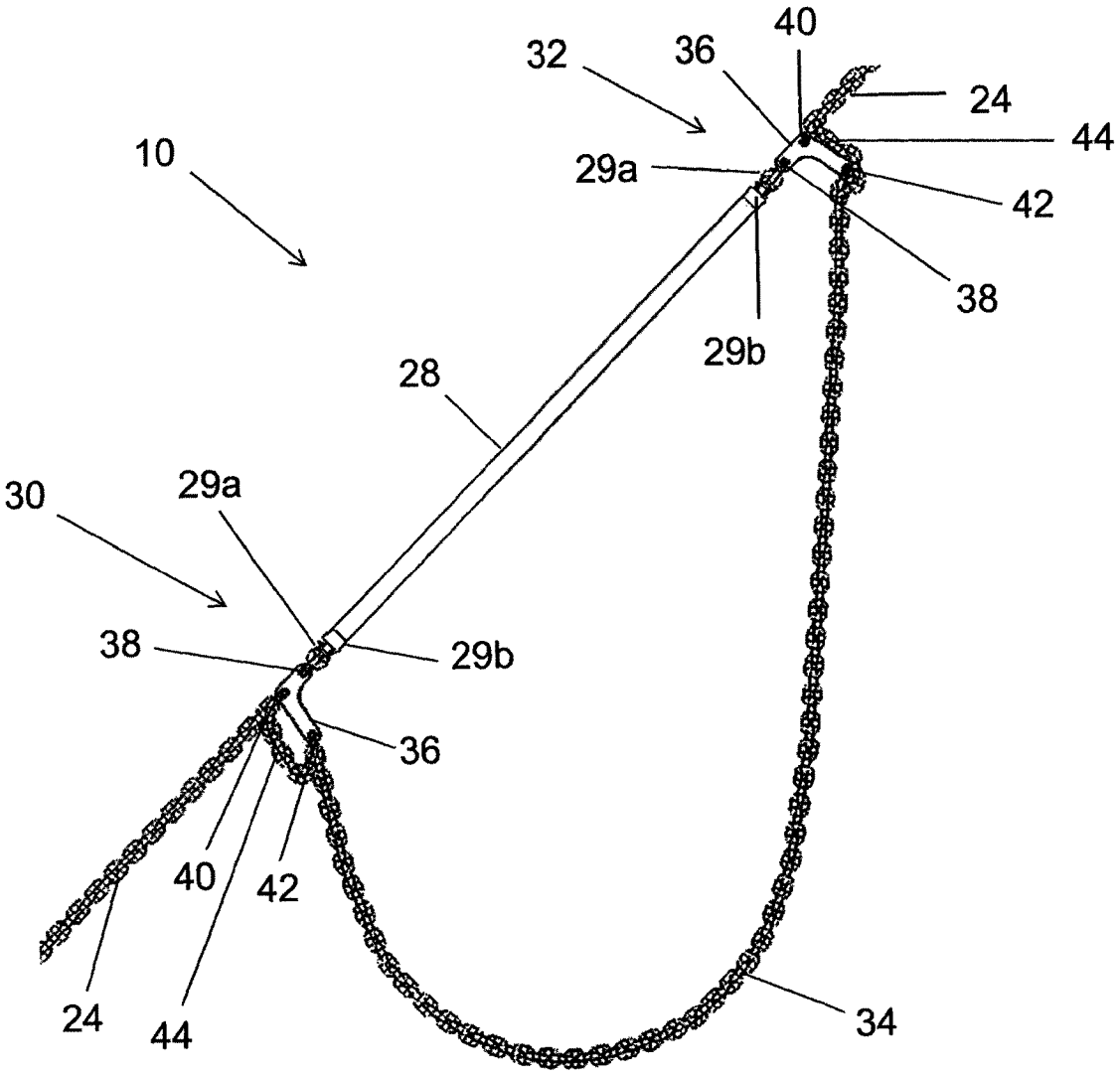
FIG. 4 is a detailed view of the mooring line seen in FIG. 3 in which a first tensile load is applied to the mooring line.

FIG. 4 shows a close-up view of the attachment points 30, 32. It can be seen that the length of 28 mm chain 24 is attached to each end of the elastomeric element 28 by a connector 36. The connector 36 has an L-shape with one arm of the 'L' shorter than the other. On each connector 36 are three attachment holes 38, 40, 42. The elastomeric element 28 is attached at both ends using a shackle 29*a* to connect to the first attachment hole 38. Each shackle 29*a* is connected to a metal end connector 29*b* that is inserted into the elastomeric element 28 with the elastomeric material moulded around the metal insert of the connector 29*b*. The moulded design of the end connector 29*b* allows for a much higher level of elongation and much higher loads than could typically be held by a crimped, clamped, or knotted end connection for the elastomeric element 28.

The 28 mm chain 24 is then attached to the second attachment hole 40 positioned at the bend between the two arms of the L-shaped connector 36. A slack portion 44 of 24 mm chain 24 is then kept loose and the 28 mm chain 24 is attached again at the third attachment point 42. The purpose of keeping the slack portion 44 is to allow the connector 36 to freely pivot during operation without putting excess forces on the 28 mm chain 24. The other end of the elastomeric element 28 is attached to the 28 mm chain 24 in a similar manner. The distance between the third attachment points 42 of the two connectors 36 is chosen such so as to bypass a slack chain section 34 of the 28 mm chain 24 which has a predetermined length greater than the initial e.g. unstretched length of the elastomeric element 28. This "bypassed" chain section 34 will only become taut and transmit tensile load once the elastomeric element 28 has reached an extension corresponding to its predetermined length. Of course the 28 mm chain 24 may be attached to the elastomeric element 28 via different connectors, some examples of which will be discussed in more detail below.

Figure 5:
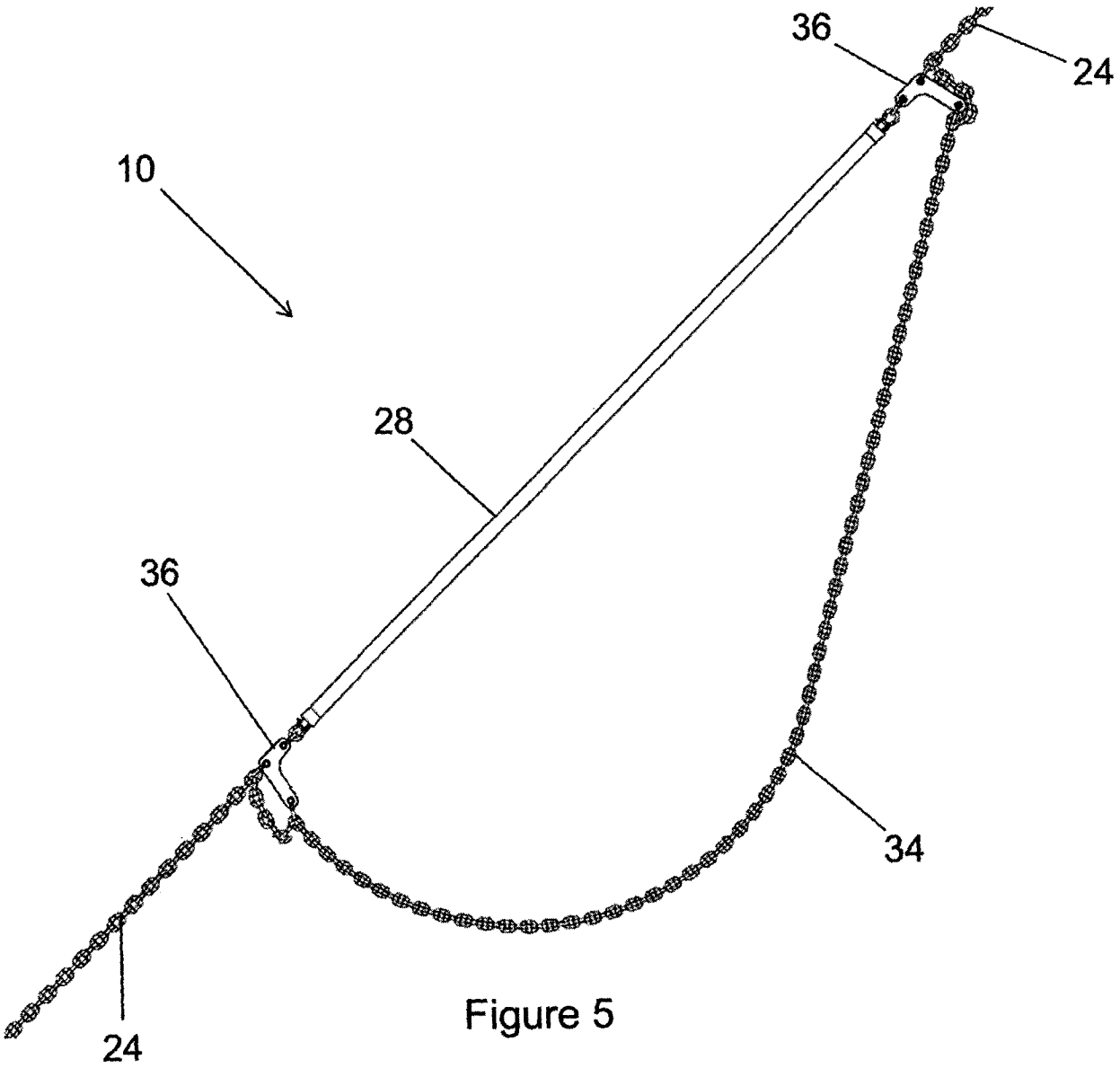
FIG. 5 is a detailed view of the mooring line seen in FIG. 3 in which a second, larger, tensile load is applied the mooring line.

Operation of the mooring line 10 will now be described with reference to FIGS. 4 to 6. FIG. 4 shows the elastomeric element 28 attached to bypass a section of 28 mm chain 24 and in an unstretched state where it is taut at its initial length. FIG. 5 illustrates the case where an increased tensile load has been applied to the mooring line 10. A tensile load applied to the mooring line 10 is transmitted directly along the 28 mm chain 24, which is incapable of elastic deformation, and therefore passes through the connector 36 and thus into the elastomeric element 28. In FIG. 5 it can be seen that the tensile load has caused the elastomeric element 28 to stretch from an initial unstretched length to a second, longer, length. It can also be seen that the bypassed chain section 34 is no longer as slack as it was in the first case seen in FIG. 4 however it is still not taut. As the tensile load applied to the mooring line is below the threshold tensile load, the entire tensile load is transferred along the elastomeric element 28 to the rest of the 24 mm chain 24. It can be seen that the connectors 36 are orientated such that the applied tensile load is transferred linearly along the elastomeric element 28 from the connected sections of 24 mm chain 24.

Figure 6:
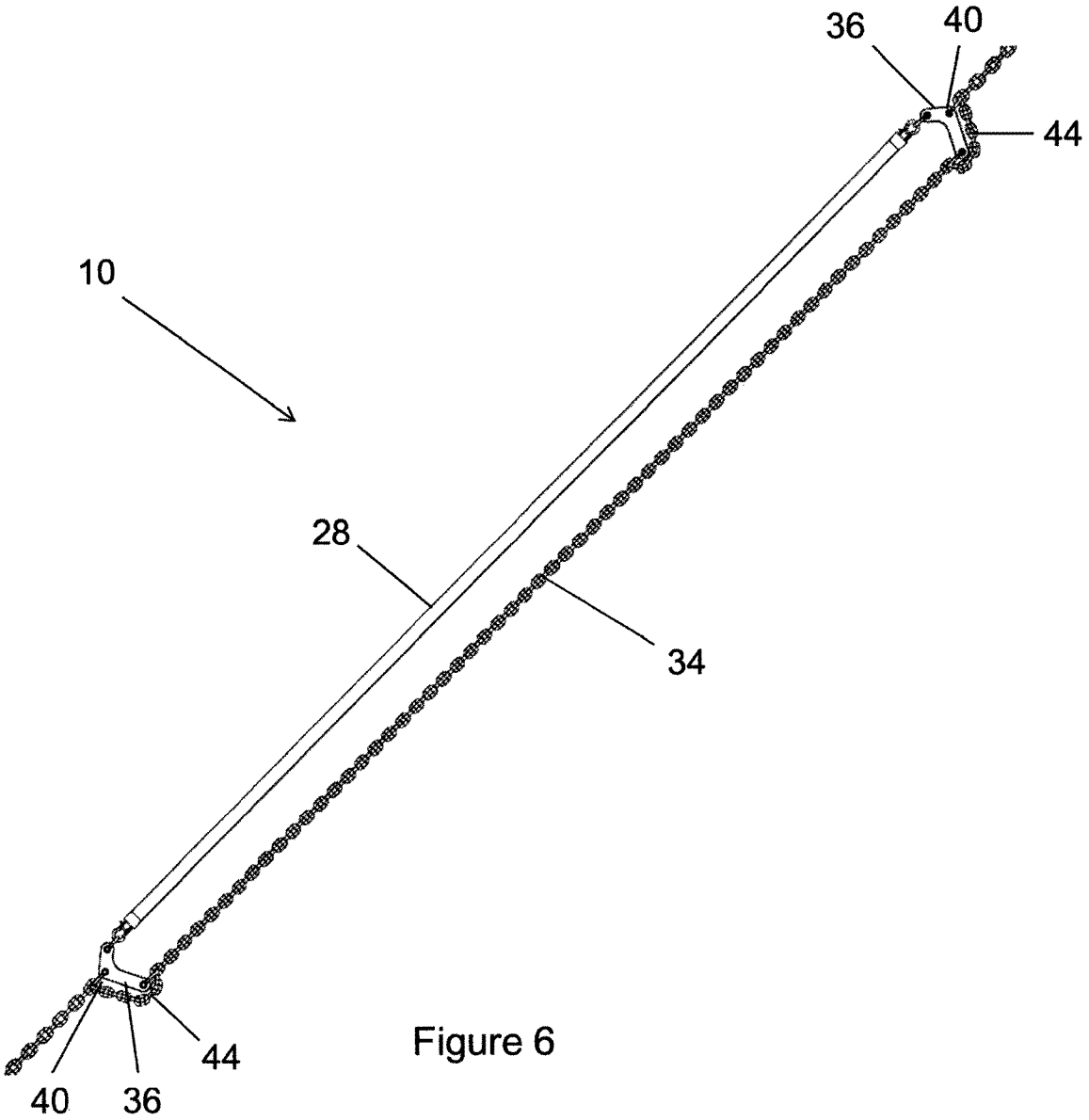
FIG. 6 is a detailed view of the mooring line see in FIG. 3 when the tensile load is equal to or greater than the threshold tensile load.

FIG. 6 illustrates the scenario in which a larger tensile load, equal to or greater than the threshold load, is applied to the mooring line 10. Here it can be seen that the tensile load is sufficiently large to stretch the elastomeric element 28 to the point where its length is the same as the predetermined length of the bypassed chain section 34. Once the bypassed chain section 34 becomes taut, the connectors 36 rotate about their second attachment point 40 such that the elastomeric element 28 is no longer directly in line with the connected sections of 24 mm chain 24. The tensile load is now shared between the elastomeric element 28 and the bypassed chain section 34, which run in parallel. It can be seen that the bypassed chain section 34 is now taut and has a predetermined length equal to the maximum stretched length of the elastomeric element 28. It will be appreciated that the elastomeric element 28 may be able to stretch to larger lengths than that shown in FIG. 6, however the predetermined length of bypassed chain section 34 is chosen specifically such that the elastomeric element 28 does not reach its elastic limit i.e. a length less than that at which it may fail. This prevents the elastomeric element 28 from over-extending and thus ensures longevity of the mooring line 10. The relevance of the small slack portions 44 can be seen in FIG. 6. When the bypassed chain section 34 becomes taut and the L-shaped connector 36 is pivoted, the slack in the small slack portions 44 is taken up and it can become taut. Without these slack sections 44 the L-shaped connectors 36 would not be able to rotate about the second attachment point 40. Of course, it will be appreciated that the connectors 36 do not need to have an L-shape. They could, for example, be V-shaped instead e.g. with arms of substantially the same length. Such connectors 36 would still act to prevent the bypassed chain section 34 from coming into contact with the elastomeric element 28 when they are both pulled taut side-by-side. The ability of an L-shaped or V-shaped connector to pivot, and change the direction along which tensile loads are applied, helps to bring the elastomeric element 28 into alignment with the connected sections of 24 mm chain 24 during its elongation phase. However this is not essential. In yet other embodiments the connector may have an alternative shape without substantially straight arms but still functioning to prevent the bypassed chain section 34 from coming into contact with the elastomeric element 28 when they are both pulled taut side-by-side.

Figure 7:
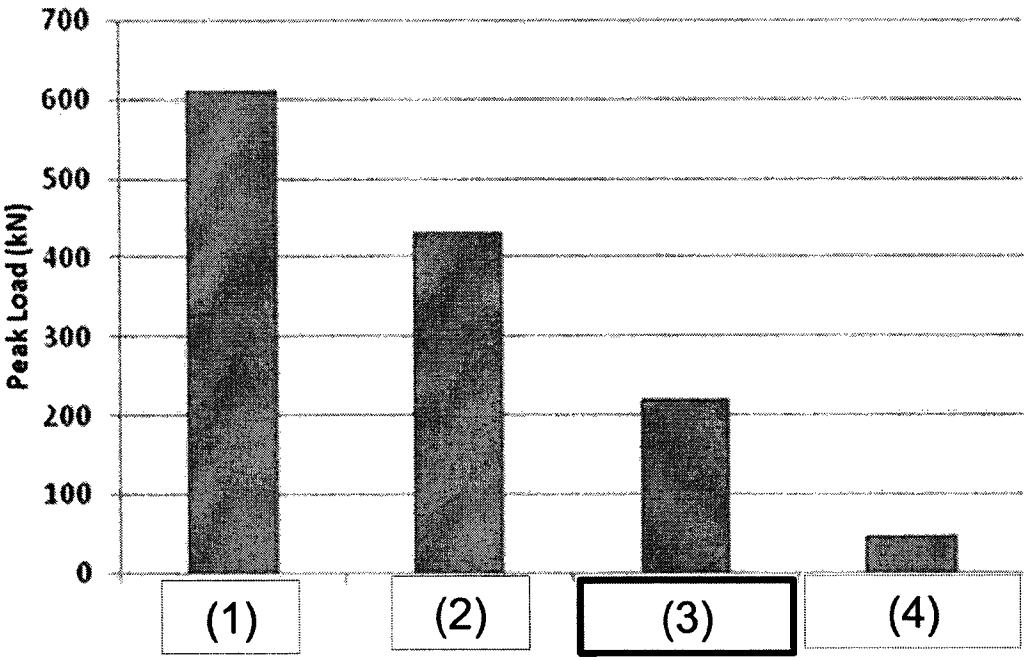
FIG. 7 is a graph showing the reduction of peak loads using different mooring lines.

FIG. 7 shows a graph of the peak loads experienced by four different mooring lines: (1) a traditional catenary mooring line (e.g. steel chain alone), (2) a mooring line comprising a compressive spring, (3) a mooring line comprising a "bypass" elastomeric element as described above, and (4) a mooring line comprising a "dynamic tether" (e.g. an elastomeric element and a compressive spring in combination). The load examples are taken from a Scottish feed barge in an exposed environment experiencing a 50 year storm. It can be seen that the traditional catenary mooring line (1) (8 lines, each 200 m long comprised of 36 mm metal chain) experiences the largest peak loads at around 600 kN. A mooring line with an in-line spring (2) (500 kN and 5 m long) experiences reduced loads at around 430 kN. The bypass elastomer line (3) (15 kN and 10 m long) reduces the peak loads to around 220 kN. This is approximately one third of the peak loads experienced in a traditional catenary mooring line and highlights the benefits of the present invention. It can be seen that the mooring line comprising a dynamic tether (4) (100 kN) provides the best reduction in peak loads (>80%). However, such a dynamic tether is costly and does not provide the fail-safe features of a "bypass" elastomeric element as described above.

Thus a mooring line comprising an elastomeric element rated at 15 kN and having an initial length of 10 m is shown to provide >50% peak load reduction, as well as shock protection, as compared to traditional catenary mooring lines.

FIG. 8*a* shows the effective tension against time on a typical catenary mooring line and FIG. 8*b* shows the same catenary mooring line with a "bypass" elastomeric element added. It can be seen that the peak effective tension 46 experienced by the typical catenary mooring line is considerably higher than the peak effective tension 48 experienced by the modified mooring line comprising a "bypass elastomer". It can also be seen that the bypass elastomer helps to generally reduce the effective tension on the mooring line as FIG. 8*b* shows lower, and smoother, peaks of the effective tension compared to that of the typical catenary mooring line seen in FIG. 8*a*. It can also be seen that FIG. 8*b* has far smoother changes to loads (even at low loads) than FIG. 8*a*, which should lead to much lower wear and tear.

A mooring line in accordance with embodiments of the present invention can be provided to assist in reducing peak loads in a wide variety of mooring situations. For example, many structures moored at sea have multiple different types of mooring lines. For example, aquaculture cages are large structures that are moored at sea. They typically comprise a large cage formed from polymer rope. Such aquaculture cages are typically moored by multiple bridle lines attached to each corner of the aquaculture cage. These bridle lines are subsequently attached to chain mooring lines. A "bypass" elastomeric element as described above may be added to the bridle lines and/or the mooring lines.

FIG. 9 is an image of a single chain link in a stud-link chain showing the shape of the metal. For a new chain the diameter of the chain will be circular. Over time, as wear occurs from the grinding of one chain link against another, the shape of the diameter will shift to ellipsoidal and the link needs to be replaced when the chain is worn too thin. One measurement often used to determine when to replace the chain link is a ratio of 0.88. When $d2<0.88 \cdot d1$ then the link needs replacement.

FIG. 10*a* shows a graph of the stress/strain response curve of a 4.5 m long, 160 mm diameter elastomeric element. The Young's Modulus at any point is defined as the applied force divided by the ratio of extension times the cross-sectional area. The Young's Modulus changes as the elastomeric element stretches, lowering as the elastomeric element elongates. FIG. 10*b* shows a graph of the stress/strain response curve of a 1.2 m long, 270 mm diameter thermoplastic compressive spring element. The Young's modulus of this element increases smoothly as it is compressed.

FIG. 11 shows a graph of the peak load experienced in the same scenario as FIG. 7 when different length 3T elastomeric elements are used. As the length of the elastomeric element is extended, the energy stored by the time the elastomeric element reaches the threshold load is greater and the peak load experienced is lower. The benefit of increasing the length of the elastomeric element reduces as the length is increased and an optimum length is normally chosen based on the cost benefits of load reduction versus the cost of the elastomeric element.

FIG. 12 shows a graph of the peak load experienced in the same scenario as FIG. 7 when different diameter 9 m elastomeric elements are used. As the diameter of the elastomeric element is extended (increased Elastomer Design load capacity), the energy stored by the time the elastomeric element reaches the threshold load is greater and the peak load experienced is lower. Increasing the diameter also increases the stiffness of the elastomeric element making it less responsive to lower loads. The benefit of increasing the diameter of the elastomeric element reduces as the diameter is increased and an optimum diameter is normally chosen based on the cost benefits of load reduction versus the cost of the elastomeric element. This is normally considered along with FIG. 11 to choose the optimum elastomeric element for a given deployment.

FIG. 13 shows an example of a typical chain clamp 50 which may be used to connect a chain 24' to the connector 36 (seen in earlier Figures). The chain clamp 50 may be used when connecting a stud-link chain 24' to the connector 36. Typically, each link 52 in the stud-link chain 24' comprises a stud 54 which connects two sides of the link 52 and divides the internal opening into two separate openings 56. When another link 52 is passed through one of the openings to form a length of chain, the remaining space in the opening 56 is typically too small to enable a shackle, or equivalent attachment means, to be attached to the stud-link chain 24'. Attachment to this type of chain 24' may be achieved through the use of a chain clamp 50. The chain clamp 50 essentially comprises two plates 58, 60 which are placed around a link 52 and fixedly held together, e.g. through the use of multiple nuts and bolts. The clamp 50 further comprises an attachment portion 62 extending from the clamp plates 58, 60 and comprising an eyelet 64 which can be used to attach the chain clamp 50, and hence the chain 24', to another component, e.g. the connector 36. The attachment portion 62 may optionally be able to pivot relative to the clamp plates 58, 60.

FIG. 14*a* shows the chain clamp 50 being used to attach the 28 mm stud-link chain 24' to the connector 36. A chain clamp 50 is attached at both attachment points 40, 42 instead of shackles as previously described. The chain clamp 50 may be modified from the typical chain clamp 50 seen in FIG. 13, for example the eyelet 64 may be formed in a thinner attachment portion 62 e.g. flat plate enabling it to mate more closely with the connector 36. Alternatively, the attachment portion 62 may comprise a forked plate that passes over either side of the connector 36. The eyelet 63 may be attached to the attachment points 40, 42 by any suitable means, for example using a nut and bolt fastener. Although not shown in FIGS. 14*a*-14*c*, it will be understood that an elastomeric element 28 can be connected to the fastener 36 at the other attachment point 38 in the same way as previously described. An arrow depicts the force applied by the elastomeric element 28 at the attachment point 38.

FIG. 14*a* illustrates the scenario, similar to FIG. 4 discussed above, whereby no tensile load is applied to the chain 24'. In this scenario a "bypassed" chain section (not shown) of the chain 24' which is positioned between the connectors 36 at each end of the elastomeric element (not shown) will hang down under gravity.

FIG. 14*b* illustrates the scenario whereby a tensile load is applied to the chain 24' such that the elastomeric element 28 (not shown) which is attached to the connector 36 at the point 38 is stretched, but not to full extension, i.e. the tensile load is below the threshold, and so the elastomeric element 28 is not stretched to a length which is equivalent to the length of the "bypassed" chain section between the connectors 36. This scenario is equivalent FIG. 5 discussed above. Arrows depict the tensile loads being applied.

FIG. 14*c* illustrates a third scenario whereby a sufficient tensile load is applied to the chain 24', i.e. equal to or above the threshold load, which causes the elastomeric element (not shown) to stretch to a length equal to the length of the "bypassed" chain section (not shown) attached between the two connectors 36. This scenario is similar to FIG. 6 discussed above.

In each of the scenarios discussed above, the chain clamp 50 functions to attach the chain 24' to the connector 36 and also allows the nearby sections of the chain 24' to pivot and rotate as the chain 24' is brought into tension under a tensile load. It can be seen from FIGS. 14*a*-14*c* that the connector 36 rotates as the loads increase, keeping the chain 24' and elastomeric element (not shown) apart.

Of course the chain clamp 50 may be used to connect the chain 24' directly to the elastomeric element without a connector 36. FIG. 15 illustrates another example of a chain clamp 64 for attaching a stud-link chain 24' to an elastomeric element 28. The chain clamp 64 is particularly well suited for attaching the chain 24' directly to the elastomeric element 28 without the need for an intermediate connector, e.g. connector 36. This will be discussed in more detail below in relation to FIGS. 17*a*-*c*. Such a chain clamp may be particularly advantageous as it may reduce the total number of components for the mooring line and thus potentially reduce its cost. The chain clamp 64 comprises a main body 66 which extends over a central portion of a link of the chain 24'. The chain clamp 64 further comprises an eyelet 68 and a shoulder portion 70. Whilst not shown in this Figure, the chain clamp 64 comprises two separate plates which are placed around a link and secured together.

FIG. 16 shows one plate 72 of the chain clamp 64. The plate 72 comprises a recessed portion 74 arranged to accommodate a link of the stud-link chain 24'. The recessed portion 74 is sufficiently deep such that when two plates 72 are brought together the combined depth of the two recesses is sufficient to house a link of the stud-link chain 24'. The plate 72 also comprises an extending portion 76 through which the eyelet 68 is provided. The plate 72 further comprises a shoulder portion 70 which extends outwards of the main body of the plate 72. The purpose of the shoulder portion 70 will be discussed below in relation to FIGS. 17*a*-*c*. The plate 72 further comprises a plurality of holes 78. When two mirror-image plates 72 are brought together, securing means, e.g. nuts and bolts, can be used with the holes 78 to secure the plates 72 together. Alternatively, the plates 72 may not comprise the holes 78 and instead the plates 72 may be placed around a link and welded together. A second plate (not shown) can be attached to the plate 72 to form the chain clamp 64. Preferably the second plate is a mirror image of the plate 72, but with opposite handedness. However this may not be necessary and, for instance, provided that the recess on the plate 72 is sufficient to house a link of the chain 24' the second plate may not comprise a recessed portion. This may result in the second plate being cheaper and/or easier to manufacture. Although not shown, a polymer sheath may be added to avoid wear between the clamp 64 and a chain held therein. A polymer sheath or spacer can also allow for a wider dimensional alignment.

FIGS. 17*a*-17*c* show the chain clamp 64 directly connected to the elastomeric element 28 via the metal end connector 29*b*. FIG. 17*a* shows the scenario wherein no tensile load is applied to the stud-link chain 24'. Here the chain 24' is loose in the chain clamp 64 and the bypassed section of chain (not shown) between the two chain clamps 64 is not taut, hanging down freely under gravity. Typically the length of the "bypassed" chain section between the chain clamps 64 is ~225% to 250% of the length of the elastomeric element 28. For example, an elastomeric element 28 of length 4.75 m is clamped at points 10-11 m apart along the chain 24'.

FIG. 17*b* illustrates the scenario whereby a tensile load is applied, such that the elastomeric element 28 is caused to stretch but to a length which is less than the length of the bypassed chain section between the two chain clamps 64. Arrows depict the forces being applied. The angle of the chain 24' changes as the bypassed section is now looping over a wider gap and therefore at a shallower angle than is seen in FIG. 17*a*. However the bypassed chain section is not yet taut.

FIG. 17*c* shows a scenario whereby a sufficiently large tensile load, i.e. equal to or above the threshold load, has been applied causing the elastomeric element 28 to stretch to the point at which its length is the same as the "bypassed" chain section between the two chain clamps 64. At this point both the elastomeric element 28 and the chain 24' are taut. As the chain 24' becomes taut the chain clamps 64 swing around and the shoulder 70 is positioned between the chain 24' and the elastomeric element 28. Both the elastomeric element 28 and the chain 24' are now linear. The shoulder 70 helps to prevent contact between the chain 24' and the elastomeric element 28 and thus helps to prevent scraping and chaffing which may otherwise damage the elastomeric element 28 and reduce its lifespan.

Of course the chain clamps 50, 64 discussed above are not limited to use with stud-link chain and may be in fact be used to attach various different types of chain, including those without studs, to the elastomeric element 28 or connector 36.

The invention claimed is:

1. A mooring line comprising a metal chain and at least one elastomeric element having an initial length; wherein the at least one elastomeric element is attached between two points of attachment on the metal chain, thereby defining a bypass section of the metal chain between the two points of attachment with a predetermined length that is greater than the initial length of the at least one elastomeric element; wherein one or more further sections of the metal chain are directly linked to the bypass section by chain links so as to transmit a tensile load directly from one section of the metal chain to the next; and wherein the at least one elastomeric element is arranged such that:

when an initial tensile load, below a threshold tensile load, is applied to the mooring line in use, the at least one elastomeric element stretches from the initial length, to a second, longer, length wherein the bypass section of the metal chain between the two points of attachment is not taut and thus the initial tensile load is transmitted from and to the further sections of the metal chain through the at least one elastomeric element; and when a further tensile load equal to or above the threshold tensile load is applied to the mooring line in use, the at least one elastomeric element stretches further from the second length to the predetermined length wherein the bypass section of the metal chain between the two points of attachment becomes taut, and thus the further tensile load applied to the mooring line is transmitted directly from and to the further sections of the metal chain through the bypass section of the metal chain;

wherein the at least one elastomeric element is attached to the metal chain at each attachment point by a connector;

wherein each connector comprises a first attachment point for the at least one elastomeric element, a second attachment point for the metal chain, and a third attachment point for the bypass section of chain, and the connector is shaped so as to pivot about the second attachment point; and wherein each connector is L-shaped or V-shaped and comprises first and second arms that are substantially straight and that are connected by a bend, wherein the first attachment point is provided at the end of the first arm, the second attachment point is provided at the bend between the first and second arms, and the third attachment point is provided at the end of the second arm, each connector thereby being L-shaped or V-shaped such that the bypass section of chain that is not able to come in contact with the at least one elastomeric element at least when the bypass section of chain is taut.

2. A mooring line according to claim 1, wherein the bypass section and further sections of the metal chain are directly linked by chain links so as to form a continuous metal chain.

3. A mooring line according to claim 1, wherein the bypass section and further sections of the metal chain consist of chain links of the same grade.

4. A mooring line according to claim 1, wherein the predetermined length is at least 1.5 times greater than the initial length of the at least one elastomeric element.

5. A mooring line according to claim 1, wherein the predetermined length is at least double the initial length of the at least one elastomeric element.

6. A mooring line according to claim 1, wherein the initial length of the at least one elastomeric element, or the distance between the two attachment points on the metal chain, is chosen such that the elastomeric element is capable of extensions of at least 80%, 90%, 100%, 110%, 120%, 130%, 140%, 150%, 160%, 170%, 180%, 190% or 200% before reaching the predetermined length.

7. A mooring line according to claim 1, wherein the initial length of the at least one elastomeric element is chosen so that, when the initial tensile load, below the threshold tensile load, is first applied to the mooring line in use, the at least one elastomeric element is taut when attached between the two points on the metal chain and the at least one elastomeric element subsequently stretches from the chosen initial length to a second, longer, length before the bypass section of the metal chain between the two points of attachment becomes taut.

8. A mooring line according to claim 1, wherein an elastic limit of the at least one elastomeric element is no greater than about 50% of the yield strength of the metal chain.

9. A mooring line according to claim 1, wherein the at least one elastomeric element comprises at least one tensile elastomeric element and/or at least one compressive elastomeric element.

10. A mooring line according to claim 9, wherein the compressive elastomeric element has a higher elastic modulus than the tensile elastomeric element.

11. A catenary mooring system comprising a floating body and a mooring line comprising a first section of metal chain resting on the floor and a second section of metal chain connecting the first section of metal chain to the floating body, and further comprising at least one elastomeric element having an initial length that is attached between two points of attachment on the second section of metal chain, thereby defining a third section of metal chain between the two points of attachment of the at least one elastomeric element with a predetermined length that is greater than the initial length of the at least one elastomeric element;

wherein the third section is directly linked to the second section by chain links so as to transmit a tensile load directly from the second section of the metal chain to the third section;

wherein the at least one elastomeric element is arranged such that:

when an initial tensile load, below a threshold tensile load, is applied to the mooring line in use, the at least one elastomeric element stretches from the initial length, to a second, longer, length wherein the third section of metal chain between the two points of attachment is not taut and thus the initial tensile load is transmitted from and to the second section of metal chain through the at least one elastomeric element; and when a further tensile load equal to or above the threshold tensile load is applied to the mooring line in use, the at least one elastomeric element stretches further from the second length to the predetermined length wherein the third section of metal chain between the two points of attachment becomes taut, and thus the further tensile load applied to the mooring line is transmitted directly from and to the second section of metal chain through the third section of metal chain;

wherein the at least one elastomeric element is attached to the metal chain at each attachment point by a connector; wherein each connector is shaped such that the at least one elastomeric element and the third section of metal chain between the attachment points are not able to come in contact with each other at least when the third section of metal chain is taut;

wherein each connector comprises a first attachment point for the at least one elastomeric element, a second attachment point for the second section of metal chain and a third attachment point for the third section of metal chain, and the connector is shaped so as to pivot about the second attachment point; wherein each connector is L-shaped or V-shaped and comprises first and second arms that are substantially straight and that are connected by a bend, wherein the first attachment point is provided at the end of the first arm, the second attachment point is provided at the bend between the first and second arms, and the third attachment point is provided at the end of the second arm.

12. A catenary mooring system according to claim 11, wherein the first section of metal chain is thicker than the second section of metal chain.

13. A catenary mooring system according to claim 11, wherein the metal chain comprises a plurality of shot lengths connected in series and the attachment points of the at least one elastomeric element are located at each end of one shot length.

* * * * *